US010046197B2

(12) United States Patent
Gordon

(10) Patent No.: US 10,046,197 B2
(45) Date of Patent: Aug. 14, 2018

(54) EXERCISE DEVICE

(71) Applicant: Fit-Novation, Inc., Owings Mills, MD (US)

(72) Inventor: Joel David Gordon, Reisterstown, MD (US)

(73) Assignee: Fitnovation, Inc., Owings Mills, MD (US)

( * ) Notice: Subject to any disclaimer, the term of this patent is extended or adjusted under 35 U.S.C. 154(b) by 0 days.

(21) Appl. No.: 15/354,523

(22) Filed: Nov. 17, 2016

(65) Prior Publication Data

US 2017/0144016 A1 May 25, 2017

Related U.S. Application Data

(60) Provisional application No. 62/391,210, filed on Apr. 22, 2016, provisional application No. 62/386,168, filed on Nov. 19, 2015.

(51) Int. Cl.
*A63B 21/00* (2006.01)
*A63B 22/00* (2006.01)
(Continued)

(52) U.S. Cl.
CPC ..... *A63B 22/0664* (2013.01); *A63B 21/4034* (2015.10); *A63B 21/4035* (2015.10);
(Continued)

(58) Field of Classification Search
CPC ..... A63B 21/00058; A63B 21/00069; A63B 21/00072; A63B 21/00076;
(Continued)

(56) References Cited

U.S. PATENT DOCUMENTS 219,439 A 9/1879 Blend
3,316,898 A 5/1967 Brown
(Continued)

FOREIGN PATENT DOCUMENTS

CH 8631 A 12/1894
CH 320410 A 3/1957
(Continued)

*Primary Examiner* — Joshua Lee
*Assistant Examiner* — Gary D Urbiel Goldner
(74) *Attorney, Agent, or Firm* — Edell, Shapiro & Finnan, LLC

(57) ABSTRACT

An exercise device featuring a pair of knee joints, each pivotally and respectively coupled to a pair of calf linkages, each of the pair of calf linkages having a foot pedal at an opposite lower end that supports low impact user-defined natural exercise gait patterns. The knee joints are supported and directed to travel by linkage and/or carriage systems that operate substantially below a user hip area, and direct the knee joints in a variety of travel paths, ranging from a constant arc, to a linear pathway, to a variety of irregular arc shaped paths, to pathways that may change during use. A secondary system coupled to the linkage and/or carriage systems provides lift and dampening forces to influence a responsiveness of the foot pedals via bending and straightening of the calf linkages about the respective knee joint, yet does not restrict back and forth travel of the respective knee joint.

22 Claims, 11 Drawing Sheets

(51) Int. Cl.
*A63B 22/06* (2006.01)
*A63B 23/035* (2006.01)

(52) U.S. Cl.
CPC ..... *A63B 22/001* (2013.01); *A63B 22/0025* (2015.10); *A63B 23/03541* (2013.01); *A63B 2022/0038* (2013.01)

(58) Field of Classification Search
CPC ..... A63B 21/00178; A63B 21/00181; A63B 21/00185; A63B 21/008; A63B 21/0083; A63B 21/0085; A63B 21/0087; A63B 21/012; A63B 21/0125; A63B 21/015; A63B 21/018; A63B 21/02; A63B 21/04; A63B 21/0407; A63B 21/0414; A63B 21/0421; A63B 21/0428; A63B 21/0435; A63B 21/0442; A63B 21/045; A63B 21/0455; A63B 21/055; A63B 21/0552; A63B 21/0555; A63B 21/0557; A63B 21/065; A63B 21/068; A63B 21/08; A63B 21/15; A63B 21/151; A63B 21/152; A63B 21/153; A63B 21/154; A63B 21/155; A63B 21/156; A63B 21/158; A63B 21/159; A63B 21/16; A63B 21/22; A63B 21/225; A63B 21/4027; A63B 21/4033; A63B 21/4034; A63B 21/4035; A63B 21/4045; A63B 21/4047; A63B 21/4049; A63B 22/0002; A63B 22/001; A63B 22/0015; A63B 22/0017; A63B 22/0023; A63B 22/0025; A63B 22/0046; A63B 22/0048; A63B 22/0056; A63B 22/0664; A63B 2022/0038; A63B 2022/0041; A63B 2022/0051; A63B 2022/0053; A63B 23/035; A63B 23/03516; A63B 23/03533; A63B 23/03541; A63B 23/03575; A63B 23/04; A63B 23/0405; A63B 23/0423; A63B 23/0429; A63B 23/0482; A63B 23/0494; A63B 23/12; A63B 23/1209; A63B 23/1245; A63B 23/1263; A63B 23/1281; A63B 2023/0441; A63B 2023/0452; A63B 26/00; A63B 26/003; A63B 69/0028; A63B 69/0035; A63B 69/182; A63B 2208/0204; A63B 2225/09; A63B 2225/093

See application file for complete search history.

(56) References Cited

U.S. PATENT DOCUMENTS 3,316,899 A 5/1967 Raeder
3,970,302 A 7/1976 Mcfee
3,995,491 A 12/1976 Wolfla, II
4,023,795 A 5/1977 Pauls
4,053,173 A 10/1977 Chase, Sr.
4,185,622 A 1/1980 Swenson
4,188,030 A 2/1980 Hooper
4,379,566 A 4/1983 Titcomb
4,456,276 A 6/1984 Bortolin
4,456,279 A 6/1984 Dirck
4,470,597 A 9/1984 Mcfee
4,496,147 A 1/1985 Little
4,509,742 A 4/1985 Cones
4,555,109 A 11/1985 Hartmann
4,561,318 A 12/1985 Schirrmacher
4,679,786 A 7/1987 Rodgers
4,685,666 A 8/1987 Decloux
4,708,338 A 11/1987 Potts
4,709,918 A 12/1987 Grinblat
4,720,093 A 1/1988 Del Mar
4,733,858 A 3/1988 Lan
4,779,863 A 10/1988 Yang
4,786,050 A 11/1988 Geschwender
4,838,543 A 6/1989 Armstrong et al.
4,850,585 A 7/1989 Dalebout
4,869,494 A 9/1989 Lambert, Sr.
4,900,013 A 2/1990 Rodgers, Jr.
4,940,233 A 7/1990 Bull
4,949,954 A 8/1990 Hix
4,949,993 A 8/1990 Stark et al.
4,951,942 A 8/1990 Walden
4,989,857 A 2/1991 Kuo
5,000,442 A 3/1991 Dalebout et al.
5,000,443 A 3/1991 Dalebout et al.
5,038,758 A 8/1991 Iams et al.
5,039,087 A 8/1991 Kuo
5,039,088 A 8/1991 Shifferaw
5,040,786 A 8/1991 Jou
5,048,821 A 9/1991 Kuo
5,062,627 A 11/1991 Bingham
5,072,928 A 12/1991 Stearns et al.
5,129,872 A 7/1992 Dalton et al.
5,131,895 A 7/1992 Rogers, Jr.
5,135,447 A 8/1992 Robards, Jr. et al.
5,149,312 A 9/1992 Croft et al.
5,186,697 A 2/1993 Rennex
5,195,935 A 3/1993 Fencel
5,242,343 A 9/1993 Miller
5,279,529 A 1/1994 Eschenbach
5,279,530 A 1/1994 Hess
5,290,211 A 3/1994 Stearns
5,295,928 A 3/1994 Rennex
5,299,993 A 4/1994 Habing
5,336,141 A 8/1994 Vittone
5,352,169 A 10/1994 Eschenbach
5,383,829 A 1/1995 Miller
5,401,226 A 3/1995 Stearns
5,419,747 A 5/1995 Piaget
5,423,729 A 6/1995 Eschenbach
5,496,235 A 3/1996 Stevens
5,499,956 A 3/1996 Habing et al.
5,518,473 A 5/1996 Miller
5,527,246 A 6/1996 Rodgers, Jr.
5,529,554 A 6/1996 Eschenbach
5,529,555 A 6/1996 Rodgers, Jr.
5,538,486 A 7/1996 France et al.
5,540,637 A 7/1996 Rodgers, Jr.
5,549,526 A 8/1996 Rodgers, Jr.
5,573,480 A 11/1996 Rodgers, Jr.
5,577,985 A 11/1996 Miller
5,584,780 A 12/1996 Lin
5,593,371 A 1/1997 Rodgers, Jr.
5,593,372 A 1/1997 Rodgers, Jr.
5,595,553 A 1/1997 Rodgers, Jr.
5,605,521 A 2/1997 Hsieh
5,611,756 A 3/1997 Miller
5,637,058 A 6/1997 Rodgers, Jr.
5,735,773 A 4/1998 Vittone
5,746,681 A 5/1998 Bull
5,769,760 A 6/1998 Lin
5,788,610 A 8/1998 Eschenbach
5,792,026 A 8/1998 Maresh
5,792,027 A 8/1998 Kordun
5,792,028 A 8/1998 Jarvie
5,792,029 A 8/1998 Gordon
5,813,949 A 9/1998 Rodgers, Jr.
5,857,940 A 1/1999 Husted
5,876,308 A 3/1999 Jarvie
5,910,072 A 6/1999 Rawls et al.
5,911,649 A 6/1999 Miller
5,964,682 A 10/1999 Sokol
5,967,944 A 10/1999 Vittone
6,004,244 A 12/1999 Simonson
6,036,622 A * 3/2000 Gordon ..... A63B 21/154 482/51
6,045,487 A 4/2000 Miller
6,152,859 A 11/2000 Stearns
6,183,397 B1 2/2001 Stearns

(56) References Cited

U.S. PATENT DOCUMENTS 6,368,252 B1 4/2002 Stearns
6,390,953 B1 5/2002 Maresh
6,551,218 B2 * 4/2003 Goh ..... A63B 22/0012 482/51
D476,046 S 6/2003 Wang
7,190,141 B1 * 3/2007 Ashrafiuon ..... B25J 9/0006 318/568.12
7,201,704 B2 4/2007 Stearns
7,226,390 B2 6/2007 Stearns
7,285,075 B2 10/2007 Cutler et al.
D555,743 S 11/2007 Wang
7,520,839 B2 4/2009 Rodgers, Jr.
7,530,926 B2 5/2009 Rodgers, Jr.
7,608,018 B2 10/2009 Chuang
7,645,215 B2 * 1/2010 Gordon ..... A63B 21/155 482/51
7,708,669 B2 5/2010 Rodgers, Jr.
7,828,698 B2 11/2010 Rodgers, Jr.
7,833,134 B2 * 11/2010 Gordon ..... A63B 21/155 482/51
7,862,482 B1 1/2011 Hsu
7,878,947 B1 2/2011 Rodgers, Jr.
D640,337 S 6/2011 Liu
7,988,600 B2 8/2011 Rodgers, Jr.
7,998,096 B1 * 8/2011 Skoog ..... A61H 3/00 601/35
8,060,945 B2 * 11/2011 Adarraga ..... A61F 5/0102 2/22
8,082,029 B2 12/2011 Honda
8,109,861 B2 * 2/2012 Gordon ..... A61H 1/0237 482/51
8,409,058 B2 * 4/2013 Gordon ..... A61H 1/0237 482/51
D703,278 S 4/2014 Horita
9,050,491 B2 * 6/2015 Gordon ..... A61H 1/0237
9,095,981 B2 * 8/2015 Brown ..... A61F 5/01
9,364,708 B2 * 6/2016 Luger ..... A63B 22/04
9,554,960 B2 * 1/2017 Kamon ..... A61H 3/00
9,675,514 B2 * 6/2017 Caires ..... A61H 3/00
9,682,279 B2 6/2017 Gordon
2002/0049121 A1 4/2002 Anderson
2002/0198083 A1 * 12/2002 Goh ..... A63B 23/03575 482/51
2003/0092532 A1 5/2003 Giannelli et al.
2004/0224825 A1 11/2004 Giannelli et al.
2005/0054488 A1 3/2005 Husted
2005/0059908 A1 * 3/2005 Bogert ..... A61F 5/0102 601/5
2005/0124467 A1 6/2005 Rodgers
2006/0189454 A1 8/2006 Bull
2007/0037667 A1 * 2/2007 Gordon ..... A63B 22/0017 482/51
2007/0219061 A1 9/2007 Rodgers, Jr.
2007/0219062 A1 9/2007 Rodgers
2008/0132385 A1 6/2008 Alessandri
2008/0261780 A1 10/2008 Giannelli et al.
2008/0287265 A1 11/2008 Giannelli et al.
2009/0203501 A1 8/2009 Rodgers, Jr.
2009/0292369 A1 * 11/2009 Kazerooni ..... A61H 3/00 623/27
2010/0093498 A1 4/2010 Fenster et al.
2010/0094185 A1 * 4/2010 Amundson ..... A61F 5/0102 602/16
2010/0094188 A1 * 4/2010 Goffer ..... B25J 9/0006 602/23
2010/0160115 A1 6/2010 Morris et al.
2010/0267524 A1 10/2010 Stewart et al.
2011/0028275 A1 2/2011 Stewart et al.
2011/0039662 A1 * 2/2011 Gordon ..... A61H 1/0237 482/52
2011/0066088 A1 * 3/2011 Little ..... B25J 9/0006 601/35
2011/0105966 A1 * 5/2011 Kazerooni ..... A61H 3/008 601/35
2011/0266323 A1 * 11/2011 Kazerooni ..... B25J 9/0006 224/575
2013/0178339 A1 * 7/2013 Gordon ..... A61H 1/0237 482/51
2013/0210578 A1 8/2013 Birrell
2014/0148311 A1 5/2014 Eschenbach
2014/0276261 A1 * 9/2014 Caires ..... A61H 1/024 601/33
2014/0276263 A1 * 9/2014 Caires ..... A61H 3/00 601/34
2014/0276265 A1 * 9/2014 Caires ..... A61H 3/00 601/34
2015/0065304 A1 * 3/2015 Luger ..... A63B 22/04 482/52
2017/0144016 A1 5/2017 Gordon

FOREIGN PATENT DOCUMENTS

CN 202682672 U 7/2012
DE 2919494 A1 5/1979
DE 10060466 A1 12/2000
EP 2000178 A1 6/2007
TW M378001 U1 4/2010
WO 2008124025 A 10/2008

* cited by examiner

EXERCISE DEVICE

CROSS-REFERENCE TO RELATED APPLICATIONS

This application claims the benefit of U.S. Provisional Patent Application No. 62/386,168, filed on Nov. 19, 2015, and U.S. Provisional Patent Application No. 62/391,210, filed on Apr. 22, 2016, the disclosures of which are incorporated by reference herein in their entirety.

FIELD OF THE INVENTION

The present invention generally relates to low impact cardiovascular exercise devices that may allow the user to simulate running, walking or other gait patterns.

BACKGROUND OF THE INVENTION

There is a market segment of low impact cardiovascular exercise devices that rely on the user to manually operate and define his or her own gait pattern from a standing position upon a pair of foot pedals affixed to a mechanical linkage system, such that, the forward, backward, up and down free-form foot pedal path of travel, is directed by the user. Unlike the standard elliptical exercise device that has a limited foot path of travel, which in some cases may be altered through the user making a non-spontaneous adjustment to the machine; these user-defined devices allow the user to impulsively transfer in and out from a variety of gait patterns, such as: walking, jogging, running, stepping and a back & forth gliding motion; where the user simply changes their gait at free-will, and the compliant machine provides foot pedals that follow under foot.

Within the limited yet growing variety of user-defined cardiovascular devices on the market today, there is one particular machine with the brand name Zero Runner that comes from the family of prior art (U.S. Pat. No. 6,036,622, U.S. Pat. No. 7,645,215, U.S. Pat. No. 7,833,134, U.S. Pat. No. 810,986, U.S. Pat. No. 8,409,058, U.S. Pat. No. 9,050,491) that features twin left and right hand mechanical linkage systems, constructed to mimic the basic size and linear mechanical pivot movement actions of the average human leg. More specifically, each leg linkage system consists of an upper (thigh) and lower (calf) linkage, each having an overall dimension corresponding to the average length of the human upper and lower leg; with these two user supporting leg linkages being pivotally coupled at a "knee" pivot joint, that generally aligns with the average sized user's knee joint elevation when standing on the foot pedals, that are affixed at the lower end of each lower "calf" linkage. The upper "thigh" linkage is pivotally coupled to an upright, rigid, ground based frame structure; at a location wide of the user's body, and generally in-line with the user's hip region when standing on the foot pedals. Providing leg linkages that mimic the general linear movements and scale of the average human leg, with pivot joints that generally align with the user's hip and knee joints, enables the average sized user to perform varied gait movement patterns, such as jogging, running, and stepping; where the fixed foot pedals continuously provide a natural tilt angle in relations to the user's foot alignment with the calf bone, throughout any gait performed. Additionally, the leg linkage system of the Zero Runner and closely related prior art, allows the average sized user to nearly maximize the length of their running stride, as well as, achieve generous heel kick-up amplitude and the rear end of their stride.

As the Zero Runner and closely related prior art provides a stride length that exceeds any other low-impact cardiovascular exercise device on the market today; the taller than average sized user will experience limitations to the maximum length that they may stride, due to the leg linkage system's limited overall length, from hip pivot joint to foot pedal surface, being shorter in overall length than the taller than average user's legs, from user's hip joint to foot bottom. Other factors that contribute to a limited range of foot pedal travel may include: frame interference issues and limitations imposed by the additional systems that are coupled to the leg linkages designed to bring dynamic function and control, to what would otherwise be, unresponsive leg linkages/foot pedals.

To accommodate the taller than average user's longer gait requirement, would require a scaling-up in the size of the prior arts' leg linkages, linkage communication systems, and systems that provide dampening and lift response that act on the foot pedals; which in-turn, would require a scaling-up of the frame rigidity and elevation of the pivotal attachment locations where the leg linkages pivotally couple to the frame at the hip pivot coupling joint. It is reasonable that the manufacturer would not elect to produce a larger in-scale machine to better accommodate the taller than average consumer, due to the substantial added manufacturing and freight associated costs; as well as, a larger sized machine would likely be less esthetically appealing, heavier and more costly to the consumer.

The present invention overcomes the above described quandary related to increasing the overall scale of the prior art equipment to accommodate the taller user. The variety of present invention embodiments, all provide that the linkage systems that support and direct the general back and forth movement of the device's "knee" pivot joints, may be scaled-up to achieve a greater range of knee pivot travel, yet does not require the elevation of the supporting frame structure to increase.

Clearly different from the prior art that relies on "hip" joints and upper leg "thigh" linkages to support and direct the path of the "knee" pivot travel; the present invention, in all its embodiments, both support and direct the "knee" pivot joints, to travel as necessary, to provide the varied gate functions, through using various combinations of linkage systems, rail guided systems, or a combination of both; all having pivotal or travel connection to a frame structure, at an elevation substantially below the elevation of the user's hips. The present invention's non-use of a machine "hip" joint and "thigh" linkage, affords the elimination of having any machine body and linkage component in the region surrounding the user's general hip area; which the market will greatly appreciate the potential for a generous increase of available free space that the user may use to obtain a substantially greater range of hand and arm movement, without interference concerns with the machine.

Engaging the upper body during a cardiovascular workout has been known to greatly enhance the efficiency and effectiveness of a workout, through engaging more muscles of the body; yet the mentioned prior art, having a frame body and linkage components in close proximity to the general user hip area, results in providing only a very limited space for performing free-form arm movement patterns or may only provide limited range arm levers. The market will welcome the present invention's substantially shorter frame, and elimination of "thigh" linkages, leaving the hip area clear of any nearby frame body and linkage componentry, allowing the user to perform free-form arm movements and/or allow for much more dynamic upper body mechanisms that may operate in a much greater volume of space.

Necessary toward bringing the Zero Runner and associated prior art, otherwise useless limp leg linkages to function dynamically in vertical space, and further enable the user to gain stability and a correct movement rhythm to achieve the level of fluid continuous leg motion necessary to feel like one is jogging and running on land, yet without the impact to the joints from pounding the ground; additional systems are coupled to each of the linkages to provide both a lifting force toward keeping the foot pedals under foot when the user lifts their feet, as well as a dampening force to control the rate the foot pedal lowers toward the ground. Where Prior art in this fitness category require portions of the lift & dampening system to occupy a region near to and above the hip pivot area; in contrast, the present invention provides a variety of systems that influence foot pedal dampening & lift, having all components of these systems located substantially below the user's hip region when using the device; and may further, generally have less a restrictive influence against the foot pedal stride length.

As, the Zero Runner relies on a close tolerance swing phase between the knee joints swinging forward and backward about the hip pivot joint to simulate jogging and running exercises, the Zero Runner does not provide the adequate out of phase knee joint separation required to perform and natural and comfortable simulation of a walking and stair stepping exercises. Walking and stepping, in particular, require a flexible degree of separation in the opposite movement relationship between the left and right "knee" pivot joints. The present invention may provide a rigid, flexible, or hybrid system of communication between the "knee" joints and/or may abandon use of a system directly linking one machine knee joint to the other.

An additional flywheel based system or other continuous flow systems may be coupled to this present invention and prior art, to influence the travel rate and fluidity of the knee pivot joints, particularly in the rearward travel phase; and further, provide a more realistic simulation of the momentum force present in the body when the body travels forward upon a surface.

As the Zero Runner and associated prior art features a "hip" joint center pivot axis from which a knee pivot must travel about having a back & forth constant arc radius; the preset invention may not only provide a non-hip driven constant arc knee pivot travel radius, but may also provide any number of different knee path travel patterns, that may be better suited to an individual suspended from a frame while standing on foot pedals performing varied gait exercises.

With the short comings of the prior art where a machine hip joint is used, the market would appreciate a user-defined device having foot pedals that follow the natural gait pattern and natural foot tilt of the user, yet eliminate the limitations imposed by having a hip joint. The elimination of the hip pivot joint and upper "thigh" linkages, may not only provide a longer stride pattern, a more customized simulation of one or more exercise gait patterns, yet will also provide a substantially lower in-stature frame structure that may reduce the volume of space the machine occupies, reduce the machine's cost, and may provide a generous space about the hip area, free of machine componentry, allowing the user a greater space to move the hands and arms.

SUMMARY OF THE INVENTION

The present invention provides a variety of embodiments that show, both linkage base configurations, as well as, a variety of guide rail travel systems, where both types of systems provide a means to both structural support and guide the general back & forth travel of the machine's "knee" pivot joints. From each knee pivot joint, a "calf" linkage is pivotally coupled at the "calf" linkage upper end, with the opposite lower ends, each supporting a foot pedal, from which the user stands supported in a generally upright position, with the average sized user's knees generally aligned with the machine's knee pivot joints, further enabling the foot pedals to more closely follow the natural tilt of the user's foot bottom during the variety of varied gate exercises.

The variety of embodiments utilize a substantially shorter in-stature floor based frame, in comparison to prior-art, where the frame and machine components are substantially below the general hip area of the user, allowing the user to perform unobstructed free-form arm movements or utilize upper body mechanisms that allow far greater range of arm movement than does prior art.

In the first embodiment of the first aspect of the present invention, a four bar primary linkage system is provided, which supports and directs the "knee" joint to swing back and forth, having a constant radius about an imaginary hip pivot point, that may generally align with the user's hip area when standing on or using the device from a general standing position upon the foot pedals. The swing radius of the "knee" joint about the imaginary hip pivot axis may be increased to accommodate the taller than average user or to provide a longer stride length, yet without the need to increase the scale of the frame support, nor have to change the elevation of the pivotal attachment coupling joints of the primary linkages of the four bar system to the frame.

In a second aspect of the first, second, third and fourth embodiments of the present invention, an alternative foot lift & dampening system is shown, which may also serve in a similar capacity if incorporated into similar prior art. This foot lift & dampening system includes a straight or curved rail that may be pivotally coupled to the frame, where the rail has a lift & dampening phase, that communicates with the lower leg or calf linkage, through making contact with a roller or attachment point that is mounted to a rearward & downward facing offset element that is affixed to that lower leg or calf linkage, pivotally directed from the machine's knee pivot joint, to encourage foot pedal upward lift and dampening against knee pivot downward movement and the downward rotation of the "calf" link, at any position along the rail that the roller travels. The lift & dampening systems, as illustrated, show the delivery of those forces acting upon the lower leg linkages, to be generated from a typical fitness dampening cylinder containing a return spring or may be generated from a variety of other types of dampening and lift components.

In a second embodiment of this invention, a linkage system made up of two pivotally coupled together linkages, where the first linkage pivotally couples to an upright side frame member near the back of the device, behind the user, and about knee height. The second linkage pivotally couples to the lower end of the first linkage, where atop the second linkage; a knee pivot support is affixed and is also used as a pivot axle for a guide roller that tracks back and forth upon an inclined side frame guide rail. This embodiment shows a straight linear frame path, yet the frame could be curved as predetermined by the manufacture, as the knee roller will follow any path defined by the shape of the frame/guide rail. The second aspect knee lift/bend & dampening guide rail is shown on this embodiment to function toward ultimately providing pedal lift and dampening, yet other similar purposed systems provided in the present invention could be used instead.

In a third embodiment, similar to the second embodiment, the knee pivot travel path is directed and defined by the shape of the frame member/guide rail, yet this third embodiment does not rely on a linkage system to laterally support the knee pivot, but rather utilizes a roller carriage system to house the knee pivot joint and provide roller means to embrace and travel forward and backward alone the frame/guide rail. The knee supporting roller carriage may provide a lighter less material based means of supporting the knee pivot joint. This embodiment further keeps the overall back and forth travel system on the lighter side, as the arm system which consists of handles directly coupled to a cable & pulley system that couples to both the left and right knee pivot roller carriage assemblies, whereby the arm handles move with respect to a linear displacement equal to the movement of the roller carriages.

The fourth embodiment of the present invention, another type of four bar linkage system, is pivotally coupled to frame side members, generally located behind the user when standing on the device; where further, the two main vertical four bar linkages have a different overall center pivot to center pivot length, resulting in a knee pivot path having a non-uniform arc path. This linkage arrangement allows a further minimization of the frame upright material and may be potentially stowed to occupy less space than when ready for use. The irregular knee path arc may provide a more continuous gait flow, whereby the back end of the knee path is not as abruptly directed upward against gravity as if having a constant arc path, which tends to prematurely slow the travel of the knee pivot, at the rearward end of the gait, which is rearward of the actual or imaginary hip pivot. Arm levers are shown mounted at the base of the frame, which may be coupled to one another to move in opposite sink from each other, may be independent from each other, may be linked to coordinate with the leg linkages, and/or may be made stationary to be used as stationary hand support.

In the second aspect of this fourth embodiment, arm linkages are provided that generally run from their forward of user handle position to a rearward behind the user end of arm pole pivotal attachment to an extending upward portion of the rear linkage of the four bar leg linkage system. The extended portion of the rear four bar linkage is several inches above the linkage's attachment location to the frame, to provide that when the knee pivot joint travels forward, the arm pole will correspondingly generally travel rearward, and vice versa. A second control link that generally runs vertical, has a lower end pivotally attached to the frame, at a position forward of the pivotal attachment of the rear four bar to the frame, and having the upper end pivotally attach to the arm pole at a position forward of the arm pole's rear pivotal coupling joint to the extended portion of the rear four bar linkage. This second control linkage ensures that the arm pole handle portion maintains a general back and forth movement path as directed by the back and forth pivot of the rear four bar linkage. The generally horizontal portion of the arm pole that runs below the hip area, may be used as a hand rail or support to aid in mounting and dismounting from the device.

In the fifth embodiment of the present invention, a device is shown having a leg linkage system for supporting and directing the knee joint to travel, having a path near to having a consistent radius with an origin generally near to the user's imaginary hip joint, where the first linkage of the linkage system has a primary pivotal connection to the frame at an elevation near to the floor, providing for a substantially reduced frame structure both in mass and in its overall height. The frame is both open in the front and the back, allowing the user to enter and exit the device from either end. The device also features step-up and step-down frame foot platforms, located on each side frame, near to and off to each outer side of the foot pedals, whereby the user may conveniently enter or exit the rear of the device, and not have to pass over a bottom structure running side to side or step-up platform that may be at a less comfortable distance from the foot pedals. This device also features upper body arm poles that directly link to their respective leg linkage, using a simplified direct system of engagement and mechanical communication that does not require the use of an independent additional linkage to couple the arm pole to the leg linkage system.

In the third aspect of the fourth embodiment of the present invention, an alternative upper body arm lever system utilizing a pair of single, relatively short arm poles, each pivotally coupled near to and forward to the machine's knee pivot joint. A control linkage pivotally attaches to an arm pole offset ear, near to the pivotal attachment location of the arm pole, generally near to the knee pivot, and having the opposite end of the control linkage pivotally attached to the rear main generally vertical four bar linkage system. The control linkage directed from the leg linkage system and attaching to the arm pole, provides that the arm pole handle portion moves in the opposite direction of the lower knee portion of the same arm pole. The degree in which the arm pole provides a range of travel distance to the user's hands, may be adjusted through the changing of pivotal attachment location of the control linkage at either of its ends, along the member it is attached, either toward or away from their associated pivot points.

In a fourth embodiment, a fourth aspect of the present invention provides third dimension of foot path travel relative to the user's hip joint, made possible through use of an additional linkage system, enabling the user to foot track laterally inward and more so degrees outward along the typical gait path. An additional left and right hand four bar linkage sets, pivotally coupled at the back of the frame, provides the lateral pivot action that generally has a pivot origin near to their respective left or right hip joint of the user, which also provides that the user may stand still on the foot pedals or perform the varied gate patterns in a balanced state, where lateral movement generally does not occur unless the user intentionally tries to do so.

As an enhancement to the present invention or to the similar prior art, a variety of mechanical systems may be incorporated into the device(s) that provide a momentum force influence to encourage a more fluid, rate controlled, and continuous movement cycle of the knee pivot joint travel, more particularly to the rearward travel phase, to better simulate the momentum forces acting on the body when traveling across a land based terrain. The system(s) may either hold a fixed range of knee pivot travel, or may allow the knee travel range to remain variable, through mechanical means that allow for variable knee pivot travel lengths, where knee pivots communicate in a rigid opposite pattern or provide for a degree of separation of travel between the knee pivots, or may be a hybrid of both a fixed and variable system. The first, second and third embodiments of the enhanced momentum feedback loop system; stores and releases the energy to and from a flywheel(s), initiated and produced by the user's manipulation of the knee pivots, particularly in the rearward direction during exercise, or may be initiated by a motor source.

The first embodiment of the momentum loop, couples to the dependent knee linkage communication system that may utilize a frame mounted center pivoting swing bar, which at each opposite end of the swing bar, a linkage rod is pivotally coupled, having an opposite end of each linkage bar coupled directly or indirectly to the knee pivot joints. The momentum loop system may provide a linkage coupling to one of the linkage rods or to one side of the swing bar, and having the opposite end of this additional linkage rod pivotally attach to a crank arm mechanism mounted to the side of the flywheel driven high torque member. Variable stride range is achieved by the crank arm's ability to automatically allow the rods pivotal attachment point to the crank arm to change its distance respective to the center rotation axis of the rotation high torque member.

The second embodiment of the momentum loop provides a variably adjusting system contained within a rotation system framework that is mounted offset from a frame member at either the forward or rearward sides of the machine. At opposite ends of the rotation system framework, a pivotally coupled arm rod extends from the root system, having an opposite outer end, that during the rotation of the root system, will follow a circular orbit around the root center axis, whereby the circular orbit is constantly variable in diameter as directed by the user or provided the user by other systems. As the circular orbit of the outer end of the arm rod increases or decreases, the pivotally attached linkage rod that engages the path of knee pivot joints, will accordingly, increase and decrease in the general back and forth travel, which in-turn increases and decreases the range of travel of the knee pivot. As the control rod within the framework of the rotation system may not only be of a fixed length, which would provide that the left and right hand arm rods have the same orbital circumference, the control rod may extend and compress to ultimately allow the opposite knee joints to move in an out-of-opposite phase communication.

In the third embodiment of the momentum enhancement system, which may have many aspect variations, a driven/drive high torque friction reliant continuously rotating high torque roller may be engaged; or in another configuration, may be brought to engage a mating surface that is coupled to the knee pivot joint. When downward and rearward force is provided by the user's body weight pushing downward and rearward during exercise, the system becomes engaged and influenced by the forces generated to and from the flywheel to influence the rearward movement of the knee pivot joints. When the user completes the rearward stroke and begins to lift the foot platform, the friction connection with the high torque roller will lessen or be eliminated, therefore allowing the knee pivot to be driven forward by the user or both by the user and/or a return spring or spring-like element.

For purposes of summarizing the invention and the advantages achieved over the prior art, certain advantages of the invention described in various embodiments have been described herein above. Of course, it is to be understood that not necessarily all such advantages can be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following description of the preferred embodiments and drawings, the invention not being limited to any particular preferred embodiment(s) disclosed.

BRIEF DESCRIPTION OF THE DRAWINGS

Embodiments of the present invention will now be described, by way of example only, with reference to the following drawings, in which.

DETAILED DESCRIPTION OF THE INVENTION

Figure 2:
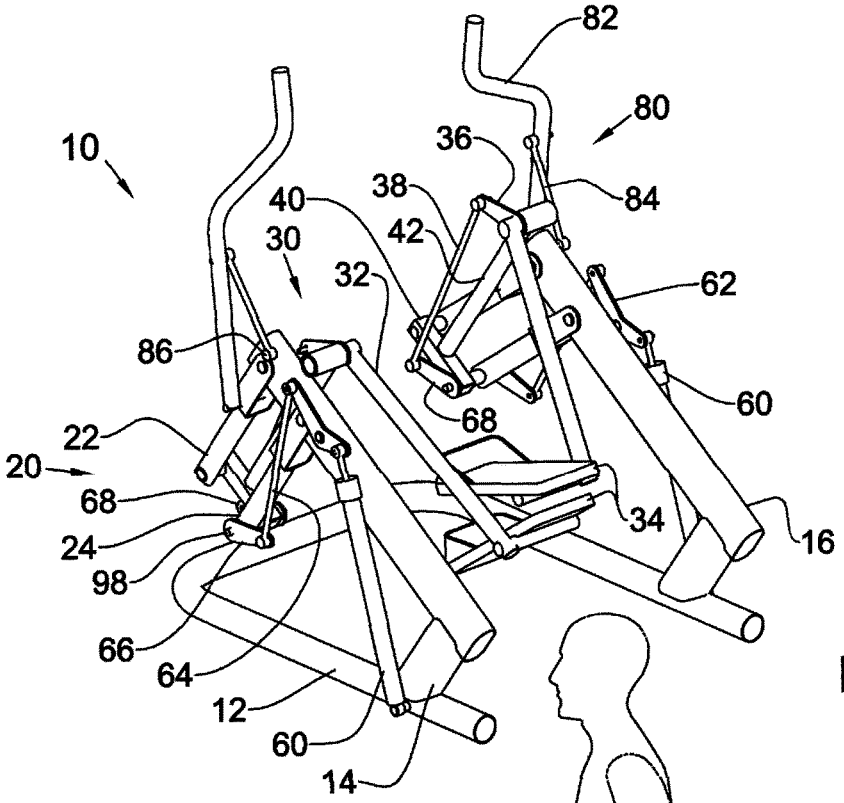
FIG. 2 is an isometric view of the exercise device of FIG. 1, shown from the front side of the device.
Figure 1:
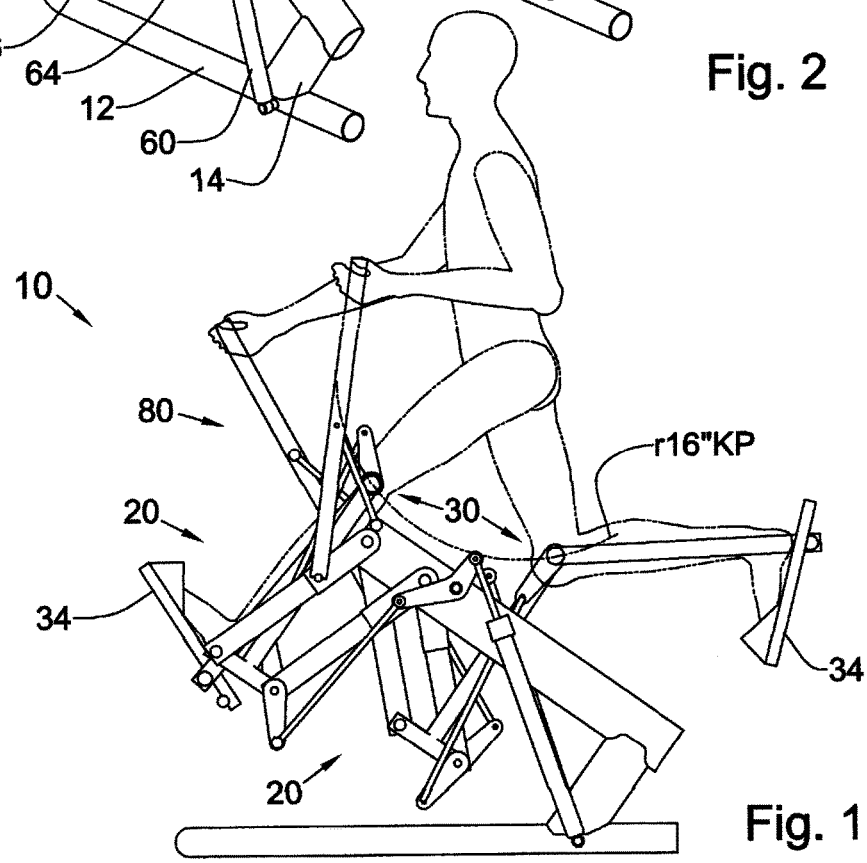
FIG. 1 is an isometric view of an exercise device produced in accordance with the present invention.
Figure 3:
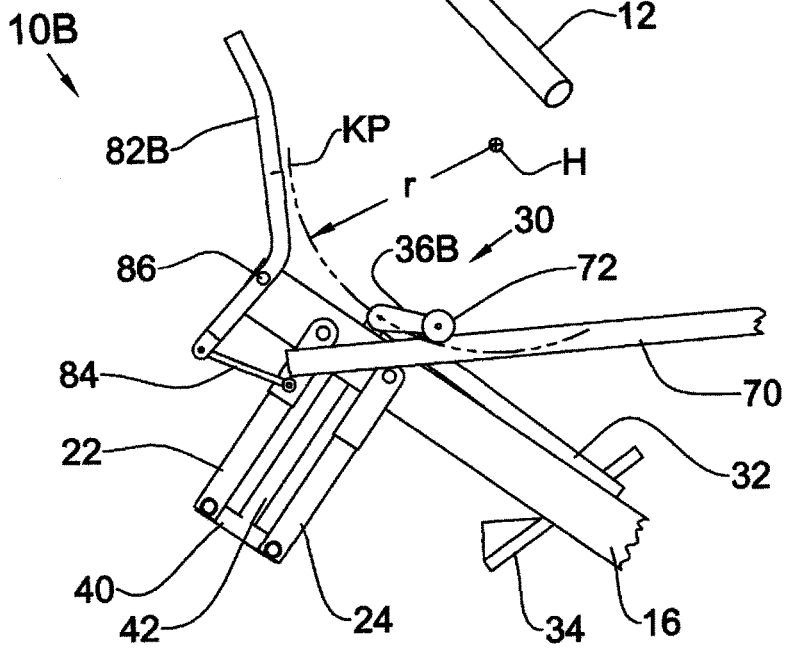
FIG. 3 is partial side view of the device of FIG. 1, featuring an alternative foot lift & dampening guide rail system.

With reference to the illustrative drawings, and particularly to FIGS. 1 thru 3, the first embodiment of the present invention, exercise device 10 including a base frame 12 with upright frame supports 14 and forward extending side frame supports 16, affixed to support a pair of four bar linkage systems 20 pivotally attached to a forward position along the frame member 16. Linkage system 20 supports a knee pivot assembly 30, whereby the knee pivot travel path KP is an arc having a consistent radius. The path radius r shown in FIG. 3 indicates arc center of origin H to likely be in general aligned or forward to the user's hips, as the radius is shown to be a length mirroring an average person's thigh bone of about 16" long. It should be appreciated that the arc radius dimension can be changed by changing the length of both main generally vertical four bar linkages 22 and 24 and further changing the length accordingly of knee pivot support member 42. Changing the length dimension of both 22 and 24 does not require a change in height of the pivot coupling points to the frame, nor requires that the arc pivot origin H change in height. Prior art, however, having human leg mimicking linkages with hip and knee pivots would require the machine's hip pivot location to rise in elevation from the floor if a larger arc radius were elected through the lengthening of the "thigh" linkage, which in-turn would require a taller frame with an elevated hip joint to ensure foot pedal clearance with the floor and base frame.

Pivotally coupled to the knee pivot assembly 30 is the shin or calf linkage 32 from which the lower end has affixed a foot support pedal 34. The pedals 34 may be suited to support the weight of the user and follow the movement defined by the user's feet during any gait pattern. The length of the shin linkage may be a similar length to the average person's shin bone, so that each foot pedal will provide adequate range of motion and stay in close alignment with the natural tilt of the bottom plane of the user's feet.

The knee pivot assembly 30 is fixed atop structural tube 42 which is welded perpendicular to four bar member 40 which 40 is pivotally coupled at each end, to the lower ends of the four bar vertical members 22 and 24. It should be appreciated that the length of these components may be change by the manufacturer or may be a manual or automatically adjustable feature allowing the change of the knee path arc radius KP to best suit the user's individual gait preference.

The four bar device 10 shown in FIGS. 1 & 2 show a foot lift & dampening system that is positioned in the vicinity about the four bar linkage system 20 terminating at a base frame 12 attachment point of the lower end of spring return damping cylinder 60. The overall arrangement of damping cylinder 60, associated engagement linkages, and pivot points to be further described, all participate toward influence of the pivot action of the shin linkages 32 where spring lift provides that the foot pedals 34 follow user foot lift, and conversely, downward swing of shin linkage 32 directed by downward user pressure upon the foot pedals 34 will be rate controlled by the damping effect of the cylinders 60, or another type of braking system that could be adopted or designed for this device and the others embodiments to follow.

Best illustrated in FIGS. 1 and 2, the foot lift & dampening system works as follows: When this device 10 is not in use the foot pedals are in a semi lifted state as a result of the spring tension coming from within the spring damping cylinder 60 which via internal spring retracts the cylinder rod back toward the cylinder body. The spring influence intended to ultimately provide pivotal lift of the shin linkage 42, starts through the transfer of pulling action from the cylinder spring 60 via a network of linkages toward the ultimate termination of communication at the shin offset ear 36 linkage attachment point. The communication path in-between begins with the pivotal attachment of the cylinder 60 extension rod to the rear side of the crank linkage 62 which is pivotally coupled to frame members 16 at a point rearward and near to the upper pivot attachment point to the frame of rear four bar linkage 24, such that the forward pivot connection of crank linkage 62 is in general proximity to the upper pivot attachment point to the frame of rear four bar linkage 24. This configuration, as well as other linkage components of this spring & dampening network, intends to optimize isolation of the cylinder 60 influence toward only the pivot action of the shin linkage 42, and not be influenced nor influence the action of the four bar linkage system 20. It should be appreciated that it may be preferred to use a portion of each spring & dampening cylinder 60 influence toward the swing path action of the knee joint. Positioning the forward pivot attachment point of the crank linkage 62 more forward in relations to the upper pivot of linkage 24 will result in a dampening of the rearward traveling knee pivot, as well as a spring return force in the forward swing direction.

Further, toward describing the spring and dampening system, connector link 64 continues the chain of connection between cylinder 60 and shin linkage 42 thru having its top end pivotal connected to the forward end of crank linkage 62, with link's 64 bottom end pivotally coupled to the rearward portion of the outside pivot ear 66. Outside pivot ear 66 is fixed to a pivot rod that passes through the bottom pivot of rear four bar link 24 and shared rear end of bottom connection link tube 40 to an inside transfer ear 68 affixed to the opposite end of the same pivot axis rod. Further, a connector rod 38 has its bottom end pivotally coupled to the forward end of the inside pivot ear 68 and has its top end pivotally coupled to shin/knee ear 36 which is affixed to the shin link 42, where the pivot attachment point at the end of the ear 36 travels in a back and forth arc about the knee pivot either directed by the shin link 42 when the user lowers the foot pedal 34, or is pulled upon by the spring force in cylinder 60 to pull the shin/knee ear thus causing a lifting pressure toward rotation of the shin link 42, therefore foot pedal 34 heel lift.

A control system may be provided to offer mechanical communication between the four bar linkage systems 20 to generally keep the pair of knee pivots 30 moving in opposite forward backward directions or to be influenced by the opposite knee action to facilitate continuous motion and user sense of stability. It should be appreciated that this type of mechanical communication via use of cable, linkages, or electrical mean may be configured to be used on any embodiment or species of this invention.

Arm levers 82 are shown on this device 10 that pivotally coupled at their bottom end to the forward four bar linkage 22, further where a range control linkage segment 84 has one end pivotally couple to the arm lever 82 at a position along the arm lever substantially above the bottom pivot connection, with its opposite end pivotally couples to the frame member 16. This arrangement of components provides that the arm levers 82 move in sync with linkage 24, yet the angle of moment between the leg linkage 24 and arm levers 82 differ such that user preference may be to limit the range of arm handle movement, yet still be connected to movement of the user's legs. If the arm levers 82 were fixed directly to one of the linkages 22 or 24 the resulting arm lever handle travel distance range would likely be too large for user comfort. It should be appreciated the arm lever range of motion can be altered by the manufacturer or whereby the user might change the pivot point, for example of the rear end of the control link 84 to the frame. The closer the pivot coupling point is to the upper pivot axis of linkage 22 to the frame, the larger the resulting range of arm handle movement.

Figure 4:
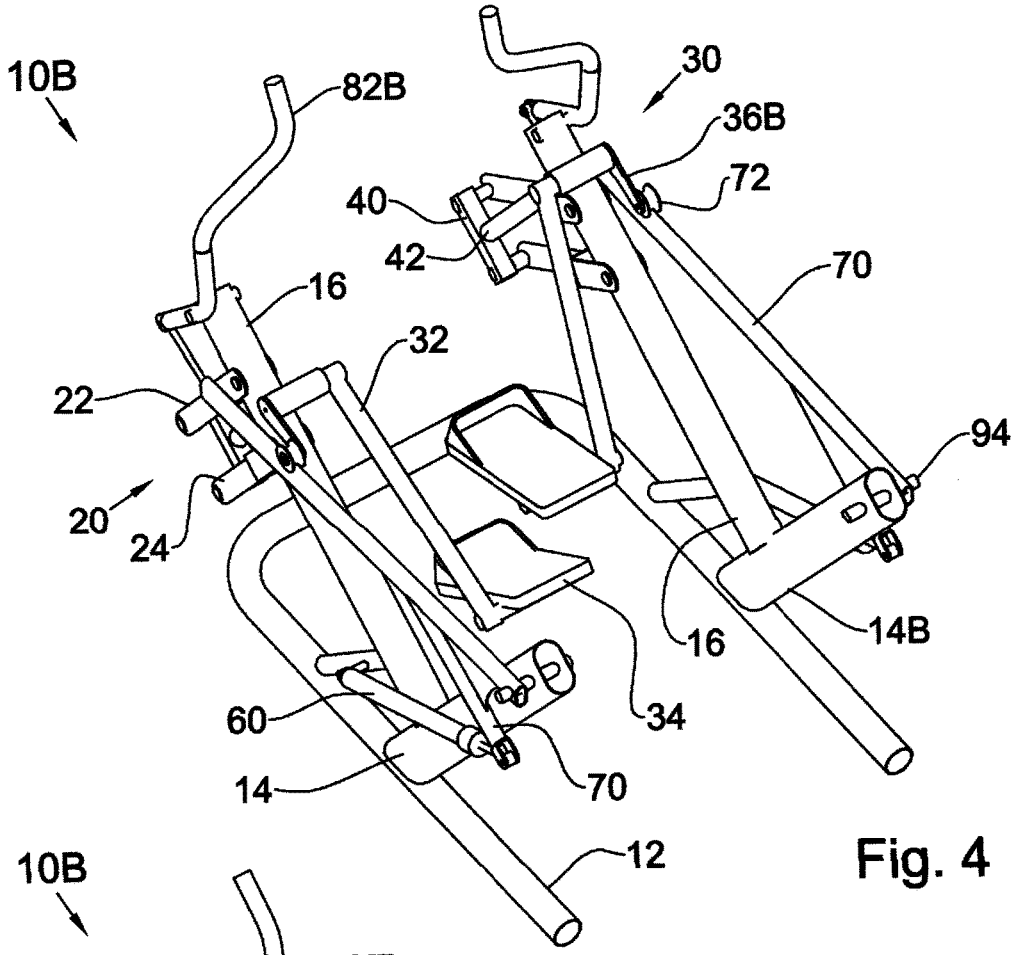
FIG. 4 is a full isometric rear side view of the device of FIG. 3.

A second aspect of the first embodiment (device 10 just described), device 10B shown in FIGS. 3 and 4, show a nearly identical frame and four bar system 20 as device 10 shown in FIGS. 1 and 2. The difference between the two devices relates to the method and mechanics that influence the foot pedal lift & dampening rate control of the shin 42, therefore foot pedal 34. Both device 10 and 10B are shown using identical spring damper cylinders 60, however the substitution of mechanical means and method of transmitting the cylinder's 60 spring lift and dampening from the cylinder 60, is ultimately felt by the user at the foot pedals 34. Device 10B features a lift & damper guide rail system 70 that has a rear end pivotal coupling to each elevated frame upright member 14B at a pivot location 94 which has an elevation generally on a similar horizontal plane as the knee pivot when in a neutral or midway of travel position. The guide rails 70 each attach to a spring return damper cylinder 60, such that a lifting force overcomes the weight of the guide rail 70 enough to further provide upward lift influence against the idler roller 72 which is mounted to the rearward side of the shin offset ear 36B. As guide rail 70 applies a lifting force upward against the idler roller 72 the shin linkage is partially rotated to lift when in neutral position and will further follow and stay engaged with the roller 72 when the user lifts their heel, typically during the last phase of a stride gate, thus resetting the cylinder to dampen as the user next pushes down on the foot pedal.

As lift and dampening happens along the entire guide rail 70 length, the advantages are as follows: This guide rail lift and dampening system not only provides a useful pedal lift and damper system for this device, it will also be shown applied to other embodiments on devices 110, 210 & 310B to follow, as well as could be used to substituted other methods used to lift & dampen on certain prior art as a non-focal point type mechanical lift & dampening system that will increase the gait range without undesirable premature dampening usually experienced as the user straightens the knee when striding forward.

Another positive significance related to the dynamics of this leverage based guide rail system 70; the forward most location along the guide rail 70 from pivot location 94 has the greatest mechanical advantage toward extending the cylinder rod to engage the damping force, which turns out to be ideal for this type of device. In other words, it is preferred that damping force for all the exercise modes begin by having a lesser to greater dampening effect as the foot pedals move downward and knee pivot travels backward. Inversely, it is most desirable that at the rear end of the user gait, the greatest & quickest heal kick up occur, which is the case, as the return spring in the spring damper 60 has a greater lifting force the closer the roller 72 is to the pivot 94. It should be appreciated that an additional roller may be used to engage the underside of the guide rail 70, or a single roller trapped in the guide rail if a guide channel is provided, so that the roller 72 remains engaged with the guide rail. It should further be appreciated that the guide rail could provide and alternative design to provide the same results as the rail and roller system, where a modified version of this system could use a telescoping bar system with a forward terminal end pivotally coupled to the same or similar location to the axis point of the currently shown and to be substituted roller 72.

The arm system on this device 10B appears at first glance to be identical to the arm lever system used on device 10; however the method that controls the range of travel of arm lever 82 & 82B differ. Device 10B, best shown in FIG. 3, also shows arm levers 82B pivotally coupled to frame member 16, yet having a portion of the arm lever extending a distance below the pivot, to receive a pivotally coupled linkage 84 which at its opposite rearward end pivotally attaches to the forward four bar linkage 22, such that and similar to device 10, the arm lever action of 82B is shown as having a smaller degree of travel relative to the travel angle range of linkage 22. It should be appreciated that it would be easy to slightly alter the geometry of components to achieve arm lever 82B having the same, less or greater range of travel.

Figure 6:
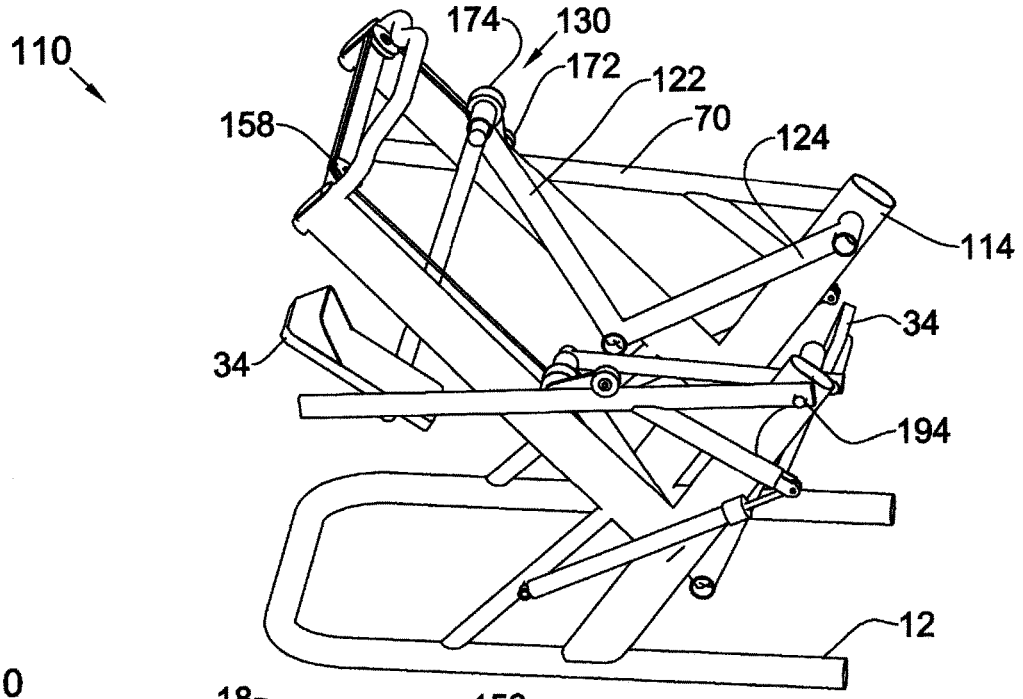
FIG. 6 is an isometric side view of the device of FIG. 5.
Figure 5:
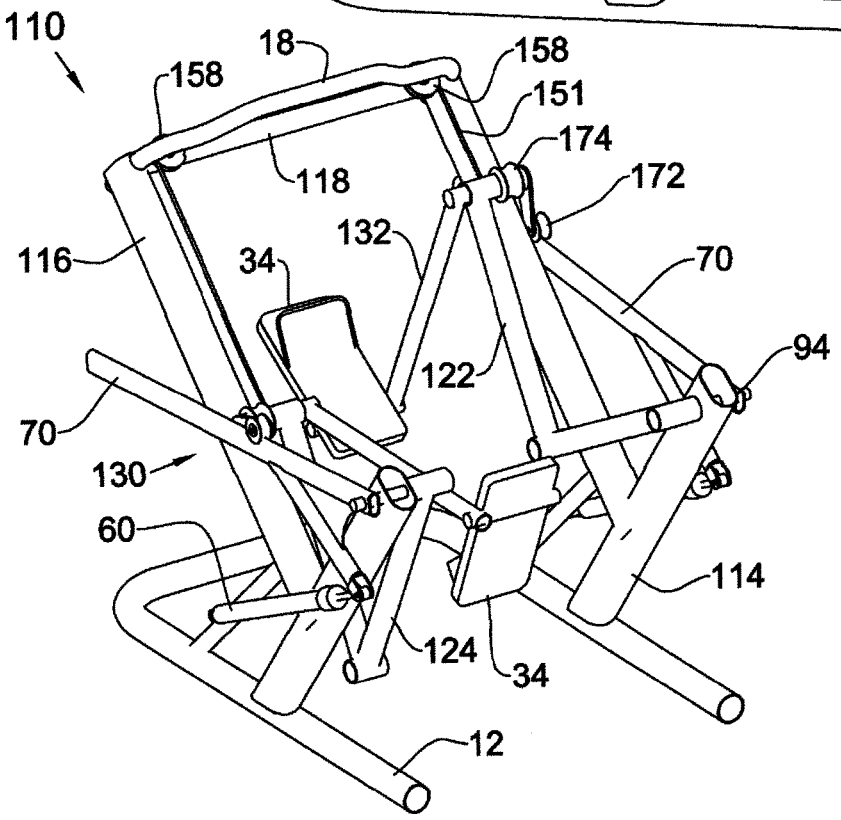
FIG. 5 is an isometric rear side view of an alternative linkage knee pivot support means that travels back and forth on a linear tilted frame member.

In the Second embodiment of the present invention, indicated as device 110 shown in FIGS. 5 and 6, provides a nearly identical lift & dampening guide rail system 70 as used on device 10B, however the travel path of the knee pivot region 130 is linear and inclined rather than an arced path of back and forth travel. A fairly steep incline of linear travel of the knee pivot region 130 as illustrated provides a full range of exercise modes similar to devices and prior art where the knee pivot region travels in an arc, yet may provide a greater range of motion resulting in an exaggerated hiker/stepper exerciser mode, for example.

Device 110 shows a frame having a floor base member 12 having upright side members 114 affixed thereto with additional forward guide rail frame members 116 attached therefrom. Forward frame cross members 118 and 18 further add rigidity to the frame structure, provide a mounting platform for guide cable pulleys 158 and provide handle bar support for the user to hold onto.

The inclined linear knee pivot travel is made possible through the application of knee pivot rollers 174 which freely rotates about the knee pivot axis 130 to travel along the top side and be guided by the guide frame members 116. To stabilize and provide structural integrity of the knee pivot joint 130 to ensure both knee pivot axis remain parallel to the floor, a pair of structural linkages are used to pivotally associate the knee pivot joint with the rear frame upright 114. A first rearward linkage 124 pivotally couples to the frame 114 near its top end, and the bottom end of 124 pivotally couples to the lower end of secondary structural linkage 122 which 122 at its forward top end contains the knee pivot joint 130.

A transfer cable 151 and pulley system consisting of idler pulleys 158 which are mounted to the upper corners of the bridge tube 118 directing cable 151 to each end of termination attached to or near the knee pivot region 130 such that the left and right knee pivots move in opposite fashion along their respective guide rails 116. It should be appreciated that the cable may be interrupted with a means to shorten and or lengthen the cable to allow the knee pivots to also move out of perfect opposite sync, and in addition the cable may be replaced with a transfer system using linkages.

Figure 7:
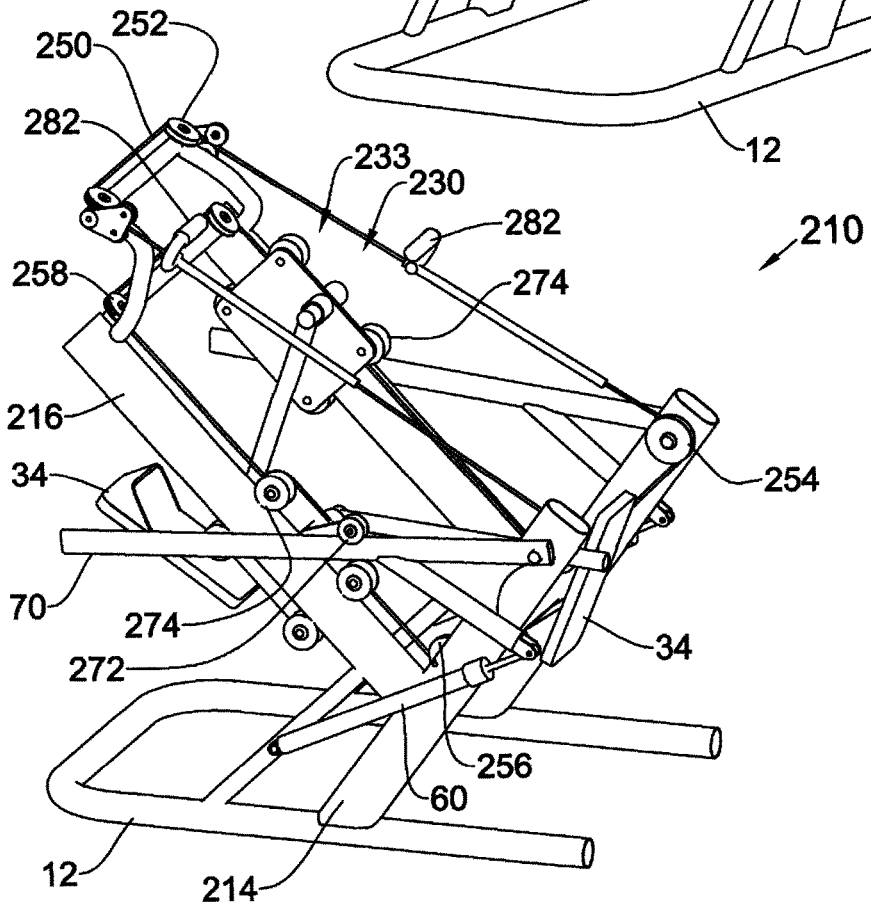
FIG. 7 is an isometric side view of a similar device shown in FIG. 5 featuring a roller carriage system to guide the knee pivot about tilted frame guide members with arm handles linked to the roller carriage system via cable and pulley system

It should be additionally appreciated that the linear path of the knee pivot along the frame guide member 116 may be altered to have a curved shape when looking from the side of the machine and/or may have a curved shape when looking at the guide rail from above, rather than a straight shape as shown in FIGS. 5-7. It should still further be appreciated that the guide rails of the spring and dampening system could also have a curved shape alone or in combination of the side rails being curved. It should still be appreciated that the first and second structural knee support linkages 122 and 124 be eliminated where the knee pivot may only be supported and directed by the guide rail system 70 or modified alike system.

Figure 8:
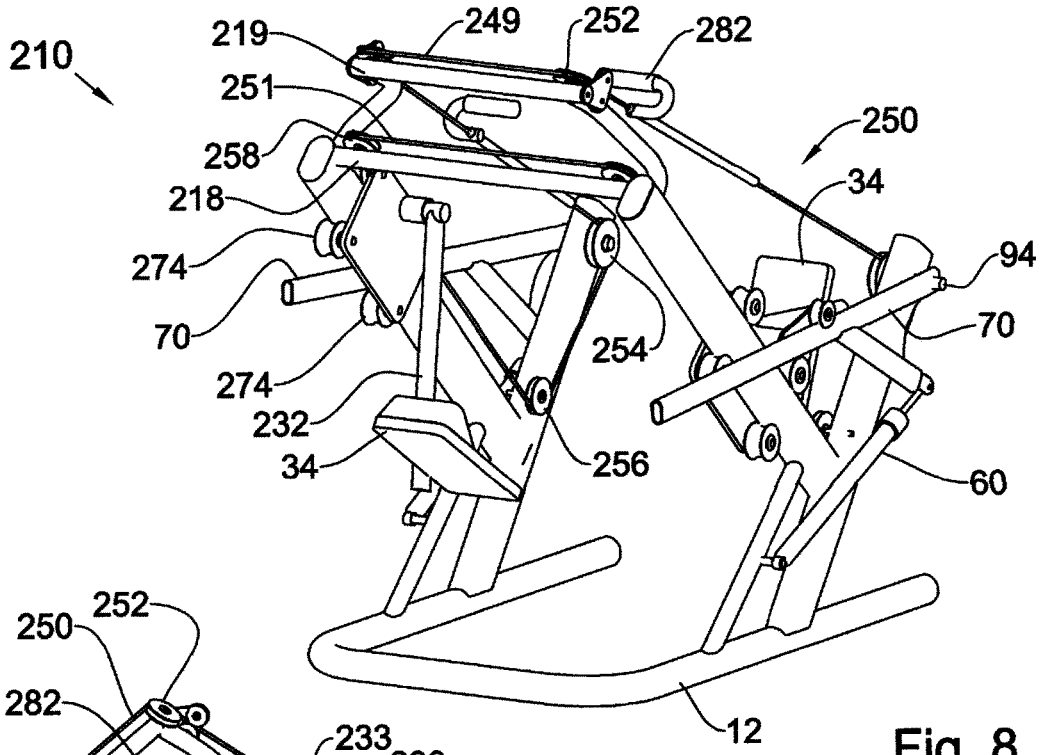
FIG. 8 is a frontal side isometric view of the device of FIG. 7.

In a third embodiment similar to device 110, device 210 shown in FIGS. 7 and 8, illustrates another mechanical method of following the guide rail frame member 216, where again the illustration shows knee travel path to be linear back and forth about the inclined frame member 216. This device 210 couples the roller carriage assembly whereby the knee pivots 230 are supported, and where there are four rollers 274 housed inside of each roller carriage housing to surround each guide rail frame member 216. This method of carrying the knee pivots 230 back and forth about the frame rail 216 is provided to reduce the weight of components associated with supporting the knee pivots with the objective of reducing the momentum which reduces the quickness that the knee pivots can change direction. The lighter weight of this knee support roller carriage system should allow the user to exercise at a quicker back & forth gate tempo, as well as reduce the weight and cost of the device.

A continuous cable system 250 is shown made up of a first lower forward cable segment 251 directed by a left and right idler pulleys 258 mounted to forward lower frame bridge tube 218. Each end of cable segment 251 attaches to and terminates at or near the forward end of the left & right hand roller carriages 233, where cable 251 has an optimal length where one roller carriage 233 may be positioned at the forward limit along the side frame member 216 while simultaneously the opposite roller carriage may be at or near the rearward limit position about the side frame member 216. Having this cable segment 251 attached and in-place as just described above, the knee pivots 230 will be able to perform an exaggerated lower body stride function if the user chooses. The added upper body arm handle feature shown on this device 210 as shown in FIGS. 7 and 8, provides arm handles 282 that move with a linear displacement equal to the movement of the knee pivots. To accomplish this: tied to the knee pivot arm handle action, a secondary cable system 250 is provided such that each end of the secondary cable 249 attaches to the rear end of each roller carriage 233. To shift the arm handle path above and generally parallel to the knee pivot path, a set of idler pulleys 254 and 256 are mounted to each side of the upright frame members 214 which directs cable 249 from their attachment points at the rear of the roller carriages to and around upper forward pulleys 254 which are mounted to the upper frame bridge member 219, where cable 251 and 249 creating a closed loop system where the left and right knee pivot members move in opposite sink, while so too do the arm handles 282, where further, the left side knee pivots also move in opposite direction near to parallel alignment with the above left arm handle 282.

Shown coupled to this device 210 is the earlier described lift & damper guide rail system 70, which it should be appreciated could be substituted with an additional cable and pulley system which would isolate lift & dampening of the rotation of the shin link 232 about the knee pivot 230, whereby the linear travel of the knee pivots would not contaminate the shin link lift and dampening movements.

Figure 10:
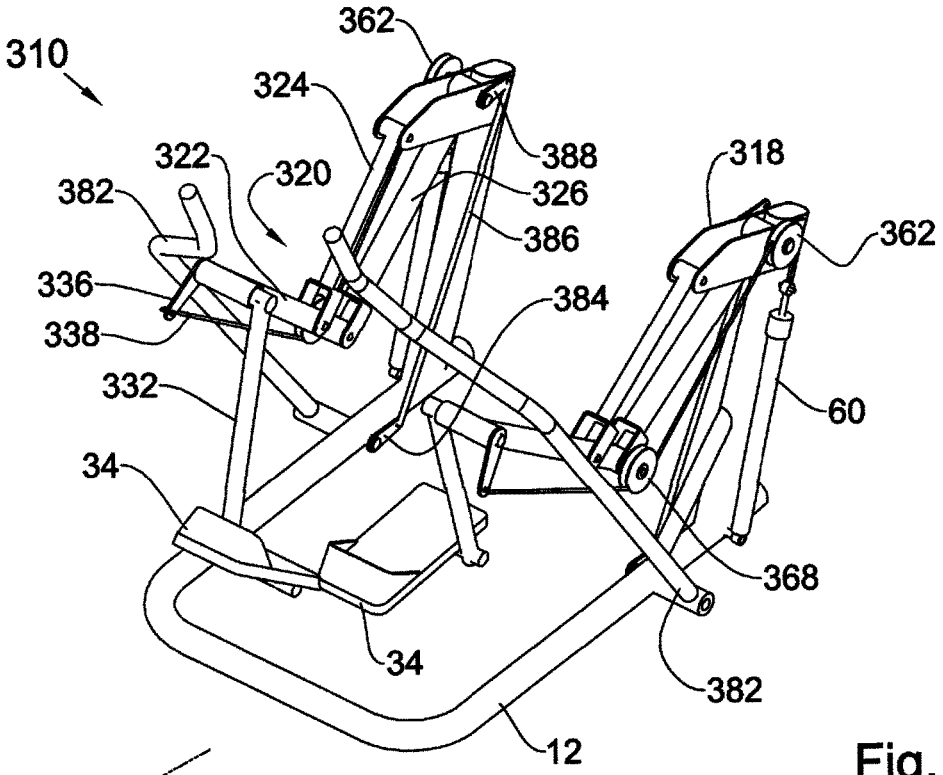
FIG. 10 is a frontal side isometric view of the device of FIG. 9.
Figure 9:
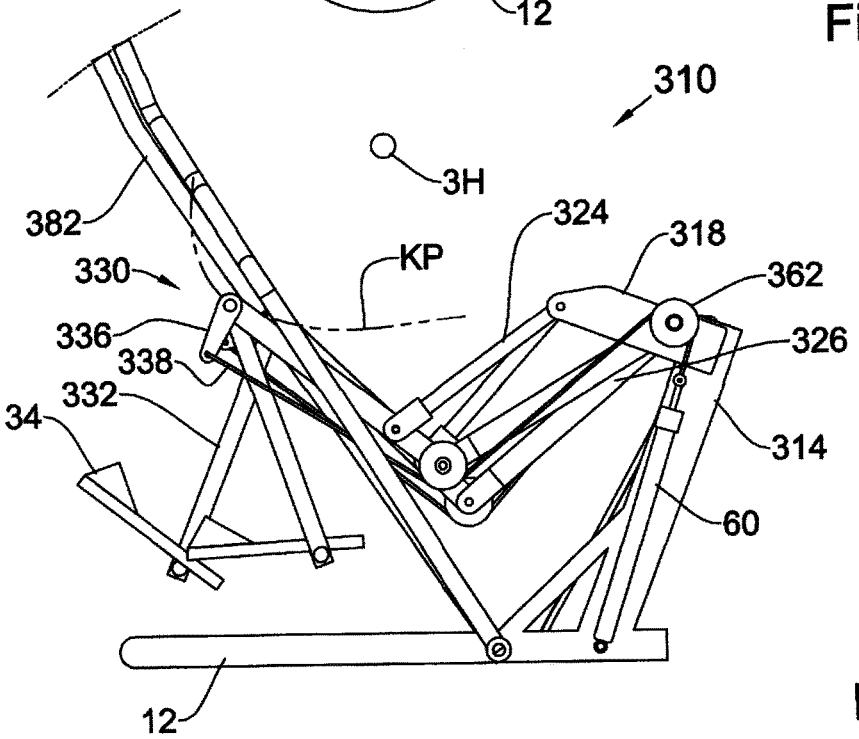
FIG. 9 is a side view of an alternative linkage system device using a four bar arrangement that produces an irregular arc movement pattern of the knee pivot joint, linked to a long arm lever bar.

In a fourth embodiment of this present invention, device 310 shown in FIGS. 9 and 10 provides an alternative four bar linkage system compared to the four bar linkage systems described and shown in the previous devices 10 and 10B where in this device 310 and 310B (shown in FIGS. 11 and 12) the two main generally vertical pair of linkages each have a different upper and lower center to center pivot axis dimension, as well as, an extended lower bar of the system from which the knee pivot is contained at the forward upper end; and further where the upper vertical main linkages of the four bar system mount from a frame bracket 318 positioned atop and forward of each frame side member 314 rearward from the user when standing on the device. The knee path KP on this device 310, as well as device 310B, to be described in more detail, both devices have an identical knee path KP that has an irregular arc which is steeper at the forward end and flattens out at the rearward end. This type of irregular knee path may provide a bigger overall stride length than prior art which uses a thigh linkage having consistent radius of close to 16". Further, the flattened arc path toward the back of the knee path KP may encourage a motion that is more continuous at the back end due to the back end having a flatter end phase where the rear flow rate should flow quicker than prior art having a radius that begins to bring the knee upward against gravity at the end of a longer type of gait pattern. Prior art relies on a tight opposite movement connection between the back and forth movements of the opposite knee paths, where the opposite still forward moving leg, helps pull through the rearward phase of the other knee. The significant potential improvement over prior art illustrated and described in this device 310 and 310B in particular, show the versatility available toward designing a device such as this where the knee path shape can be dialed-in by the manufacture toward improving the overall feel & performance over machine's that have a fixed arcuate knee path. It should further be appreciated that one or both of the linkages making up any of the four bar link systems of this invention may have the ability to be user adjustable in length or may automatically adjust in length during use, where the link(s) may, for example, have telescoping characteristic with internal or external springs and/or dampers affecting the telescoping action.

Figure 11:
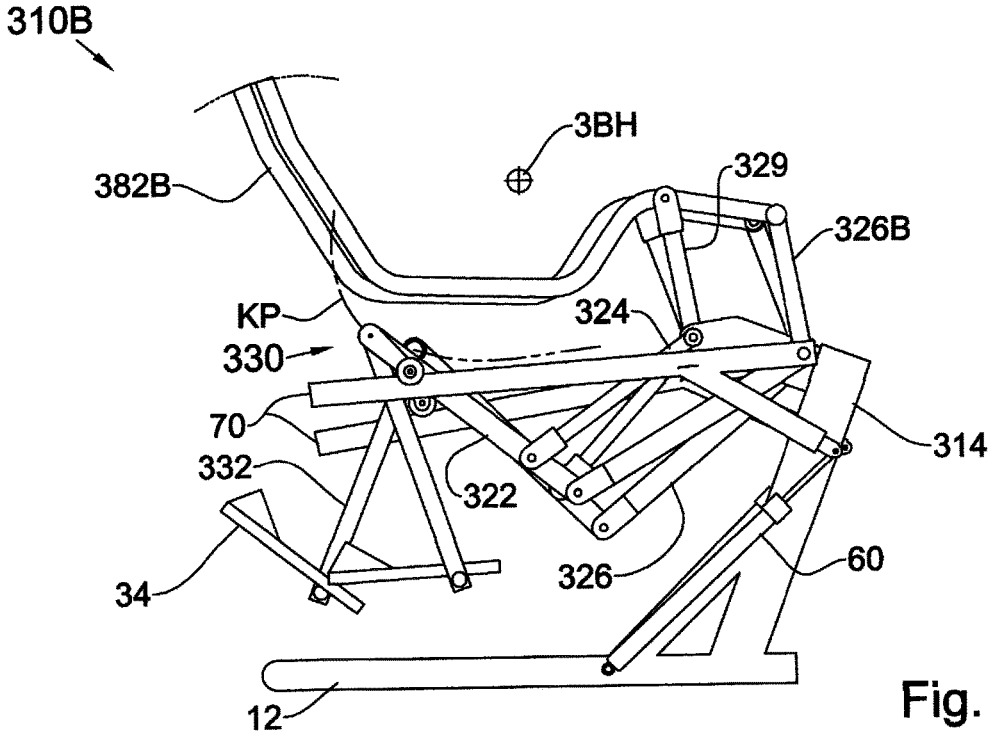
FIG. 11 is a side view of the device of FIG. 9 showing the lift & damper guide rail system featured on FIG. 3 and an alternative four bar arm lever system.
Figure 14:
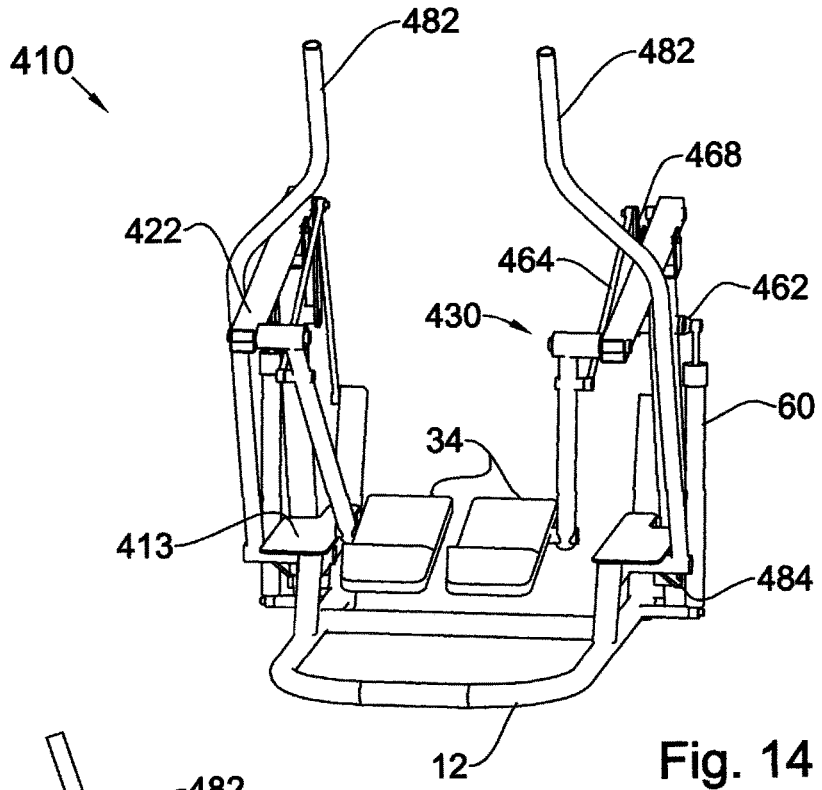
FIG. 14 is an isometric frontal perspective view of the device shown in FIG. 13
Figure 13:
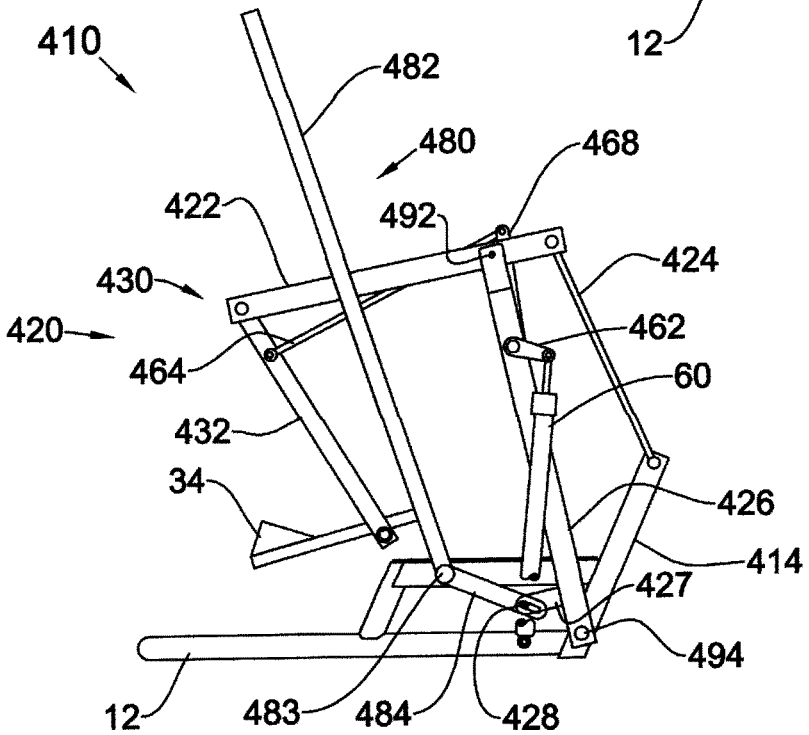
FIG. 13 is a side view of the left side of a device featuring another linkage system method for supporting and directing the knee joint utilizing a substantially minimized frame structure.
Figure 16:
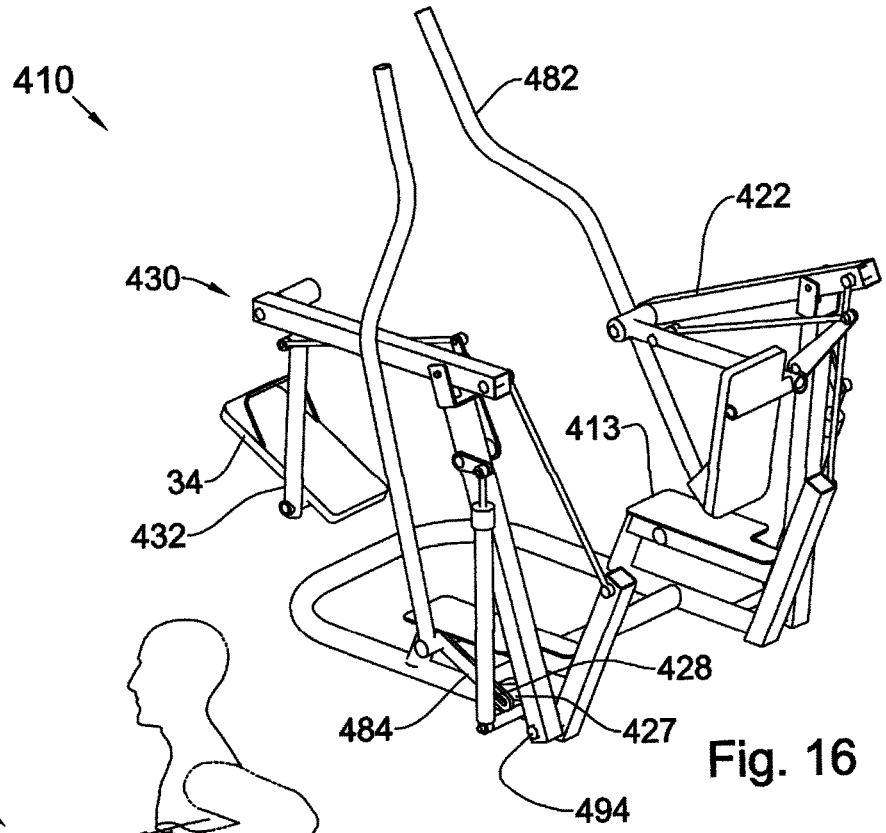
FIG. 16 is a side rear isometric view of the device shown in FIG. 15.
Figure 15:
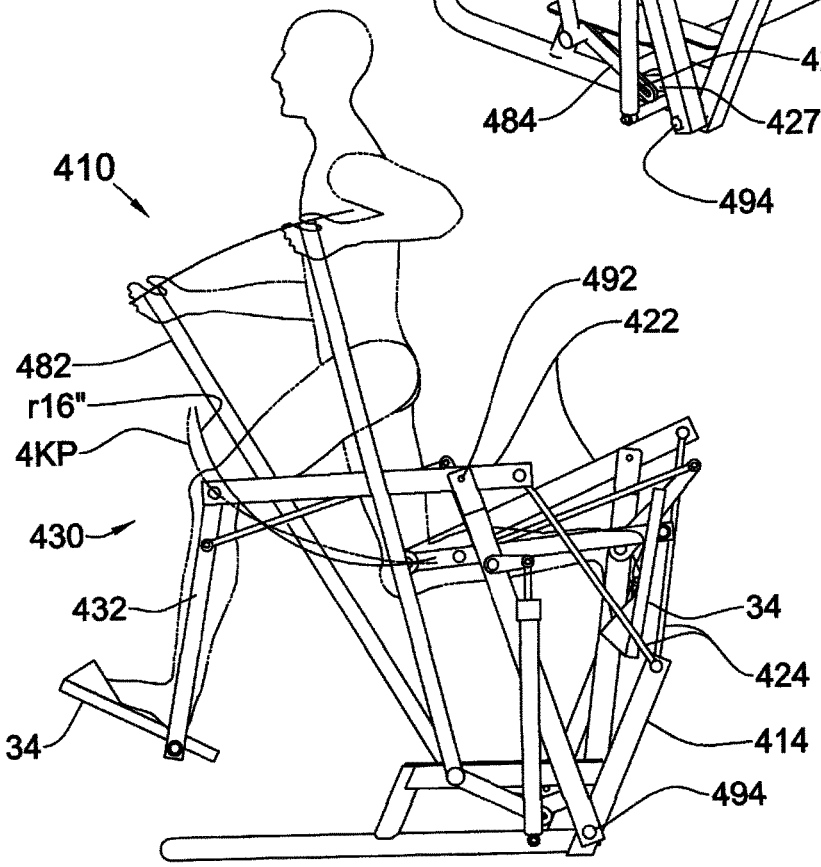
FIG. 15 is a side view of the device shown in FIG. 13 featuring a phantom user shown running on this device.

Device 310 shown in FIGS. 9 and 10 has a base frame 12 with rear affixed uprights 314, which have forward brackets 318 which have two pivot locations per bracket 318 to receive the mounting of modified four bar linkage system 320. The first rear structural linkage 326 of the four bar linkage system 320 has its top end pivotally sandwiched in-between the frame bracket 318 where a bolt could be used to hold and stabilize linkage 326, only allowing a forward and backward swing. At the low end of the linkage 326 is a fixed bracket which provides for the pivotal coupling of the bottom four bar linkage knee pivot support tube 322 which at the upward forward top end contains the knee pivot axis bearing elements. Along the same knee pivot support tube 322 near to and forward of the bottom end coupling to linkage 326, is an attachment hole location to which the secondary control link 324 of the four bar system pivotally attaches. The same control link 324 at its lower end shows having a bracket which provides that a bolt may pass through the components to create one of the four pivot support locations. The top end of the control link 324 is pivotally coupled to the most forward frame bracket 318 attachment-hole-location. The distance between the hole locations on the frame bracket 318, as best seen in FIGS. 9 and 11 is space further apart than the pivot center distance between the lower rear end of the knee pivot support tube 322. In addition, the control linkage 324 has a shorter dimension than linkage 326, which results in the knee path KP having an irregular arc as indicated with phantom lines. It should be appreciated that the geometry related to linkage lengths and pivot locations of the elements of this type of four bar system 320 can be altered to produce a knee path following a variety of different path shapes beyond the knee path KP of this device 310 and 310B. Again, as earlier mentioned one or both linkage members 326 and/or 324 may be able to shorten or lengthen before or during use to produce a more dynamic and ever changing knee path to best suit the user. It should also be appreciated that this invention illustrating a variety of linkage systems that both support and provide a travel fixed or variably changing generally forward and backward travel path, may be substituted using likely many other possible linkage based systems, guide rails means and/or combination using both linkage and guide systems.

A fairly simple lift & damper system is shown on device 310 which is isolated to influence the pivot action about the knee pivot 330 of each shin link 342. An offset linkage 336 having a pivotal axis through the knee pivot, also provides a pivotal attachment point for the cable segments 338 which from its forward of knee attachment point to offset linkage 336 than runs down along side of the knee support tube 322 and then partially around the idler pulley 368 having pivot attachment with the elbow joint, where tube 322 pivotally attaches to linkage 324. The cable 338 than direct upward, generally alongside linkage tubes 324 up to than encircle second idler pulley 362 mounted at or near the rear bracket pivot attachment location, and then the same cable 338 engages and attaches to the base mounted spring return dampening cylinder 60. Similarly mentioned earlier pertaining to device 10, the upper second pulley 362 could be position, for example, in a more forwardly position, whereby the a portion of spring lift and dampening would be applied toward the knee path movement and not just isolated to only influencing the shin linkage 342 rotation.

An arm lever system is shown on this device 310 which includes arm lever poles 382 pivotally mounted in mirror fashion between both the left and right sides of the base frame 12. The back and forth pivot action and range of motion 3AP of the arm poles 382 are controlled and associate with the movement of the rear four bar linkage 326 through linkage communication between arm poles 382 and linkage 326. On the inside of the base frame 12 is a rearward pointing linkage ear 384 having a pivot axis fixed to the arm lever base pivot, whereby the ear 384 and arm lever 382 move in sync. A generally vertical linkage 386 has a bottom end pivotally coupled to the ear 384 and a top end pivotally coupled to an upper ear 388 which is fixed to the upper pivot of the linkage 326, such that upper ear 388 moves in sync with linkage 326. It should be appreciated that certain component making up the upper body system linked to the leg action, may have dimensions altered to provide for lesser or greater range of movement or handle movement path 3AP.

It should be appreciated that the arm poles may be disengage from communicating with the leg action and may lock and hold a stationary position where the user could use as stationary handle support or the arm poles may pivot outward to allow the user to freely move arms about without fear of interference with the arm poles.

Figure 12:
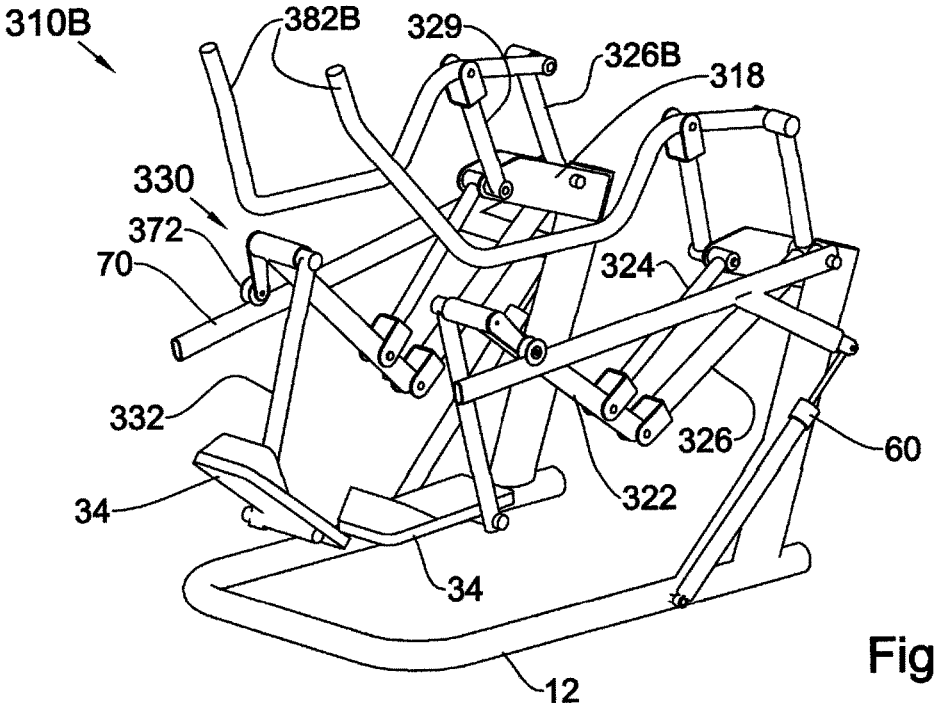
FIG. 12 is frontal side isometric view of the device of FIG. 11.

A second aspect of the fourth embodiment of the present invention, device 310B, shown in FIGS. 11 and 12, illustrates the same four bar linkage system and frame shown and described in the last device 310. The only differences relate to the upper body mechanism and the lift & dampening system, which lift & dampening system is used in almost identical fashion here as used and described in devices 10B, 110 and 210. The upper body system incorporated into this device 310B is similar to arm system in device 310, in that both arm pole movements are directed and linked to the legs or knee pivot path movement. The rear most end of the arm poles 382B are pivotally coupled to the upper end of extension tube 326B which is affixed at its lower end to the rear linkage 326. Forward of and generally parallel to the extension tube 326B is an independent control linkage 329 shown to have a lower free pivot mounted to the inside of bracket 318 in-line with forward frame bracket pivot location. The upper end of the independent control link has a surround bracket shape to allow a secondary pivotal connection with the arm handle bars 382B.

In a fifth embodiment of the present invention, indicated as device 410, shown in FIGS. 13-16, provides a left and right-hand leg linkage system 420 that supports each knee pivot 430 as the knee pivot travel path 4KP, shown in phantom line having an irregular arc generally near to a consistent arc, which is shown in solid line having a radius of about 16" with a center-radius shown generally in-line to the phantom user's hip joint 4H. The leg linkage members 420 supporting and directing the knee pivots 430, consist of two main structurally supporting and directing linkages 426 & 422, which are pivotally joined to one another having a shared pivot axis 492. Pivot axis 492 is located at a bracket that is fixed to the upper end of the primary first linkage tube 426. The second linkage 422 at the forward end there is a fixed knee pivot rod to which the lower leg linkage 432 pivotally couples. Both the lower leg linkage 432, which at its lower end the foot pedal 34 is affixed, and the second linkage 422 pivotally couple to the first linkage at pivot location 492 which is a few inches forward of the rear end of the second linkage tube 422. The three pivotally associated linkages 432, 422 and 426 are pivotally coupled to the side frame tube 414 at an elevation near to the floor at pivot axis 494. It should be appreciated that pivotal connection of the knee support/guide linkages 420 to the frame in such a near-to-floor fashion at pivot joint 494, allows for a considerably less substantial and simplified frame design to be had to provide the adequate rigidity of the pivot structure at pivot axis 494.

The addition of the fourth linkage 424 is required to control the knee support/guide linkages 420 to move in a fashion directing the knee joint 430 to move as indicated, as knee path 4KP. This fourth linkage segment 424 has a lower end pivotally connected to the upper end of structurally sound side frame member 414, with the upper end of forth linkage segment pivotally attached to the rear end of second linkage 422. It should be understood that side frame members 414 are fixed to base frame 12, yet it should be appreciated that side frame members 414 may be hinged to the sub-frame to potentially allow the fold-down and collapse of the entire device for convenient low profile storage and/or transport.

Arm poles 482 pivotally mount to the side of the base frame at pivot location 483. Coupling of the arm poles 482 to their respective leg linkage system is achieved through the slide-able pivot mating between the fixed-to offset arm pole member 484 engagement with leg linkage member's 426 offset member 427, whereby the rearward swing of the leg members 420 simultaneously correspond to the forward swing of the arm poles 482. It should be appreciated that the arm poles may function independent from the leg linkages and from one another; or the arm poles may be independent from the leg linkages, yet be dependently linked together to move in opposite swing phase which may provide safety and stability to the user, where holding onto both arm poles will disallow the user from falling forward or backward from the machine. This independent arm action from the leg linkages provides that the leg linkages may or may not have their knee pivots dependently linked together.

Figure 18:
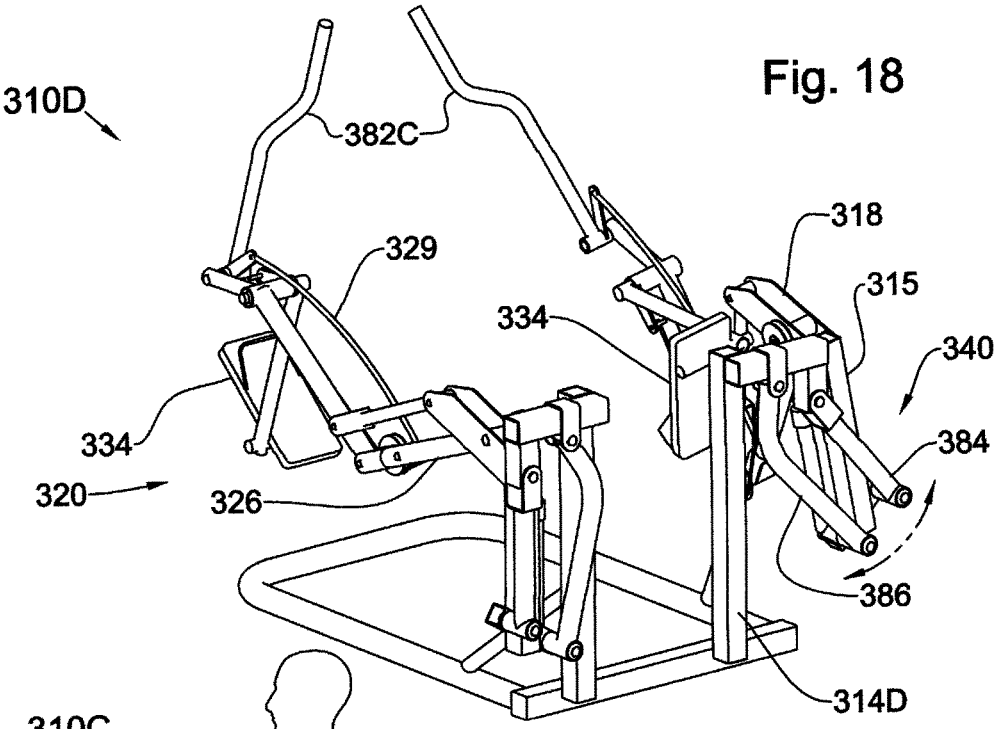
FIG. 18 is an isometric rearward perspective view of a device similar to FIG. 17, showing a new feature, where the right leg linkages are shown pivoting outward.
Figure 17:
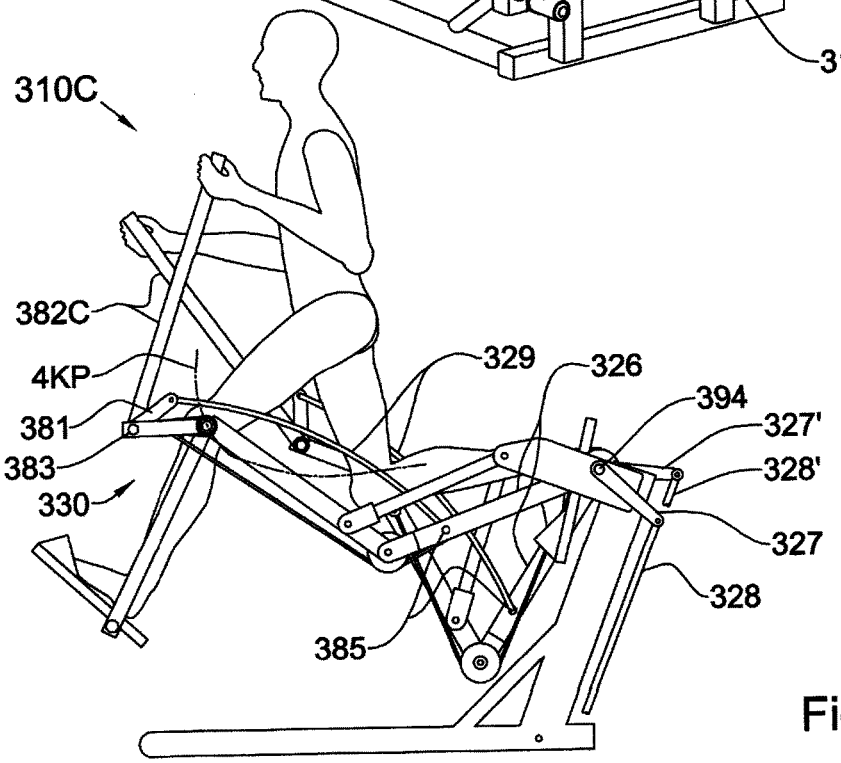
FIG. 17 is a side view of a device with user figure shown in a running stride

In the fourth embodiment, a third aspect of the present invention indicated as device 310C, shown in FIG. 17, features a third variation upper body arm pole system for this general embodiment 310, where a first and second variations of upper body mechanism are illustrated in FIGS. 9-11. The arm mechanism featured here, in FIGS. 17 and 18 provides a shortened arm pole 382C that pivotally attached to a forward of the knee pivot location 383. The movement pattern of the lower end pivotal coupling of arm pole 382C at forward of knee pivot location 383 moves in a back and forth path that remains parallel to the irregular arc path pattern of the knee pivot joint 330.

As the upper portion of arm pole 382, generally where the user would grasp to further stabilize user sense of balance and to engage the upper body via arm movement involving the users to pivot the shoulder, bend and straighten the elbow joints to engage or follow the movement action path of the generally upper portion of the arm poles. As it is preferred and found to be a more natural movement pattern that the user's knee and corresponding hand move back and forth in a general opposite direction from each other, it becomes necessary to add a means to cause a pivot action at arm pole low-end pivot joint 383 to provide that the upper portion of the arm pole moves in the opposite direction of the pivot joint 383 and knee pivot joint 330. The added means used on this device 310C and 310D to provide the desired opposite corresponding back and forth movement between the user's hands and knees is accomplished with the addition of a simple rigid or mostly rigid control linkage rod 329, which has a forward end pivotally coupled to the arm pole 382C at a location 381 that is affixed and offset from the bottom of each arm pole generally above and between the arm pole pivot 383 and knee pivot 330, and the rear end of the linkage rod 329 is shown to be pivotally attached at location 385 upon the rear main linkage 326 of the four bar linkage system that supports and direct the movement of the knee joints. It should be understood that changing the pivotal attachment location of one or both ends of the control linkage rod 329 along the parts (326 and 381) to which they attach will produce either a smaller or greater degree of pivot movement of the arm poles or, in other words, will have an impact on the back & forth travel distance of the user's hands while holding on to the upper portion of each arm pole.

A partially illustrated knee to knee pivot communication system 335 is shown as just one of a variety of potential methods of linking the knee joints to one another. In this illustration example, both linkages 327 couple to their respective pivots 394 and linkage 326, such that, the degree of pivot rotation of linkage 326 about pivot 394 must cause the same degree of pivot rotation of offset linkage 327. Also shown, linkage rods 328 at their upper ends, pivotally couple to their respective offset linkage 327, where the back and forth movement of the knee joints will correspond to the up and down opposite movement pattern of the linkage rods 328. The lower ends of the linkage rods 328 may be coupled to the variety off opposite knee joint communication systems and/or momentum enhancement systems, such as those shown in FIGS. 19 and 20. It should be understood that this device and the others embodiments shown in this present invention, a communication between the knees may not be present, or may be the communication or coupling of the knee joint to one another may be rigidly dependent or may be coupled by a system that provides flexibility in the system where the knee joints my not always have to move in a precise opposite swing phase, or the communication system may provide flexibility in the opposite swing phase, yet one leg may provide the transmission of a force to assist or act against the movement of the opposite knee's travel path.

In the fourth embodiment, a fourth aspect of the present invention, indicated as device 310D, shown in FIG. 18; introduces an additional type of four bar linkage system 340, shown to be pivotally attached or configured at a modified back frame of the device, to function in a lateral direction, providing the opportunity for the foot pedals 334D to be manipulated by the user, in addition to travelling forward, backward, up and down; to also laterally travel (LP) inward, as well as, to a greater degree, outward; having an angle of lateral travel origin, generally near to the imaginary pivot location of the corresponding user's hip joint. The benefit of having a lateral pivot origin near to the user's hip joints, help ensure that the foot pedals 334 maintain a neutral lateral position when the user is at standing at rest or when performing at a regular linear general forward and backward gait pattern when standing on the foot pedals 334D. In other words, standing on the foot pedal will generally not cause a lateral movement, unless or until the user intentionally drives the foot pedal laterally inward or outward engaging additional muscles not exercised during a typical back and forth gait.

The lateral four bar linkage system 340 couples to the knee pivot support four bar linkage system 320, via frame bracket 318D fixed to the upper end of the extension tube member 315 that at its lower end is fixed to the bottom and generally horizontal short four bar system tube. The lateral pivot origin generally near to the user's hip pivot is produced by the varying lengths of each of the two main generally vertical four bar linkages 386 and 384 and there slanted positional pivotal attachment to the rear frame tube 317. It should be appreciated that an alternative method to produce a similar lateral pivot about the user's hips might include a single laterally capable structural tube member, pivotally attached to a fixed frame member at a location generally on the same horizontal and vertical plane of each of the user's hip joints and located at the rear of the machine if incorporated into a machine having a similar configuration. The lower end of the "structural tube member" would then be fixed to support the main four bar linkage system that supports and direct the knee pivot joints.

It should further be appreciated, that still a further dimension of foot pedal travel may be provided, which may simulate a person changing direction of travel, i.e. simulating left & right turn capacity, through providing that each (left & right hand) leg linkage system is attached to a vertically aligned pivot joint that may be generally directly below and or above each of the user's hip joints. To further clarify, if the user is standing still with each foot on their respective foot pedal, the user with the additional dimension of movement possibility would be able to rotate the foot pedal inward and outward on a general horizontal plane, which may also be performed when exercising. To further expand on the level of possibility toward simulating real world experience when traveling on varying sloped terrain, the vertical aligned frame supporting pivot joints that allow left & right turn capability, could be fixed to a generally horizontally positioned structural plane member, having the ability to tilt in a variety of up and down angles about a 360 degree circle, having a center position generally in-between the hip pivot joints that allow left & right turning. Causing the structural horizontal plane to tilt may be accomplished with three pivotal attachment points located a generally equal distance on the general horizontal plane, creating a triangle if looking from above or below the plane. The three attachment points may provide a manual, semi-manual and/or power operated linear actuator, to enable and control the multi aspect tilt about the 360 degree surface about the general center of the horizontal plane.

Figure 19:
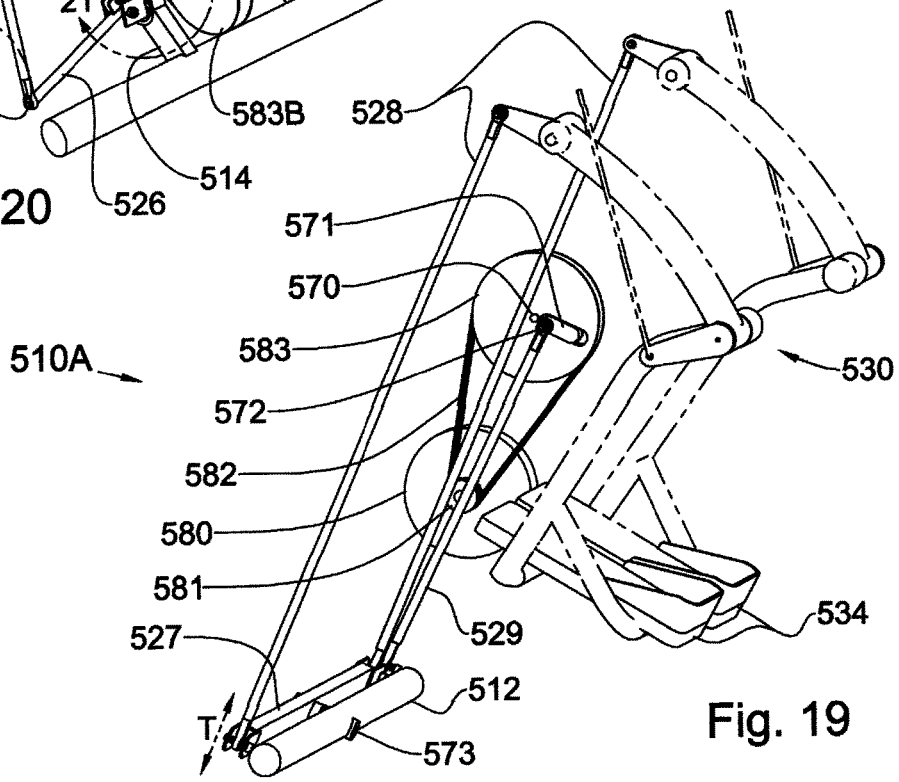
FIG. 19 is an isometric view of a momentum feedback loop enhancement system shown coupled to the leg linkages of partially exposed prior art.

A first momentum enhancement system embodiment, indicated as 510A, shown in FIG. 19, is coupled to a varied gait prior art apparatus (in phantom line), illustrating the system's influence to the general back and forth knee pivot travel path, by way of attachment to the prior art device's upper "thigh" linkage system. It should be understood that this first aspect 510A, as well as, the second aspect momentum enhancement system 510B, shown in FIG. 20, may be coupled to the present invention, as well as, prior art similar to this present invention, or may even be coupled to provide variable stride and enhanced momentum and rate control on elliptical type exercise machines.

In this FIG. 19, the momentum enhancement system 510A is directly linked to the prior art's upper "thigh" linkage system, via pivotal coupling of the lower end of linkage rod 529, at the illustrated far end or device's left hand side of the swing bar 527. The center pivot mounted swing bar 527 is pivotally coupled to the machine's base frame 512. Each end of the swing bar 527 is pivotally coupled to the lower end of their respective left and right hand, generally vertical, linkage rods 528, with the upper ends of linkage rods 528 pivotally coupled to an offset member of the prior art's respective "thigh" linkage. In this instance, the knee pivot joints 530 move in a close tolerance opposite swing phase pattern as directed by the swinging action of the swing bar 527. It should be appreciated that the linkage rods or modified versions of same may on other embodiments of this present invention or other prior art, could run in a non-vertical fashion.

The coupling of the momentum enhancement system via the linkage rod 529, provides that the reciprocating up and down travel (T) of the linkage rods 528, in turn, generate the rotation of the momentum enhancement system, through the upper end of the linkage rod 529 being pivotally attached to a moveable crank bar 571 that is housed within the high torque disk 583. The pivotal attachment location 572 may spontaneously, through user intention to change the length of their stride, cause a change in the distance from the center rotation of pivot 570, as the pivot attachment point 572 orbits around the pivot axis 570, similar to a bicycle foot pedal crank arm, where the foot pedal axil represents pivot 572. The further the attachment point 572 is from the pivot axis 570, the longer the knee joint overall stride length.

The torque necessary to adequately influence the system and provide the user a greater sense of continuous fluid movement and or rate control, is generated by the rotational energy stored and released from the flywheel 580, which rotational force is further enhanced by multiplying its torque through the use of a drive/driven pulley system. Energy is released into the system through the rotation of the flywheel 580, which directs its energy through the affixed small sheave 581 that shares the same axis of rotation as the flywheel 583, in this embodiment; than the energy from small sheave is transmitted through belt 582 to large sheave 583, where the torque is multiplied at the large sheave's rotation axis 570. It should be appreciated, that the moveable crank bar system 572 may be modified or enhanced to better communicate the intention of the user to change the length of stride to the actual change of position of the attachment point 572 with respect to rotation axis 570.

Figure 20:
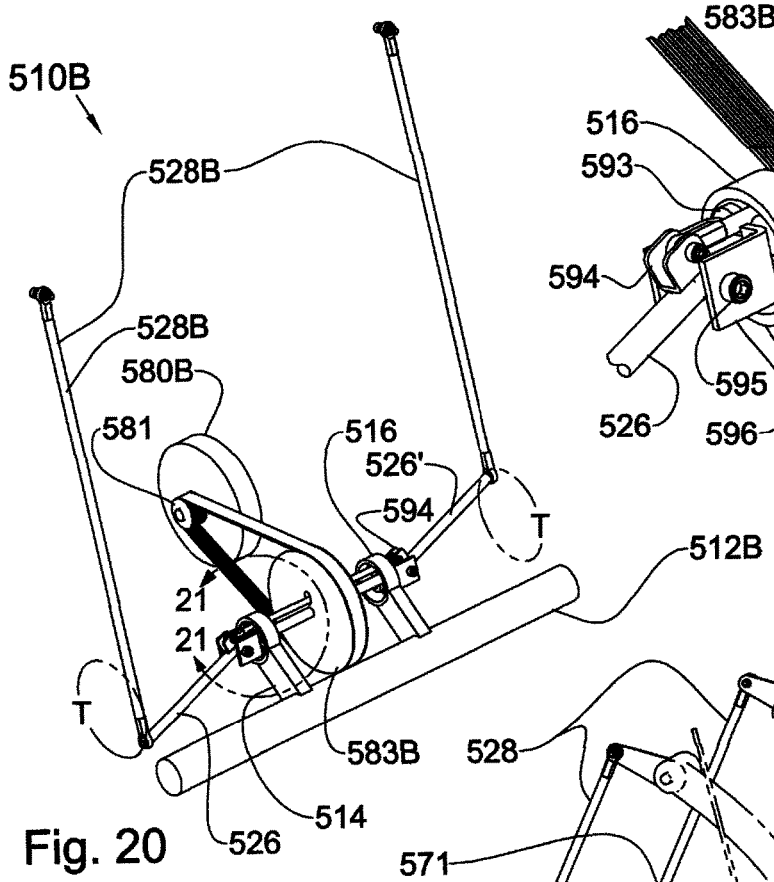
FIG. 20 in an isometric view of another type of momentum feedback loop system.
Figure 21:
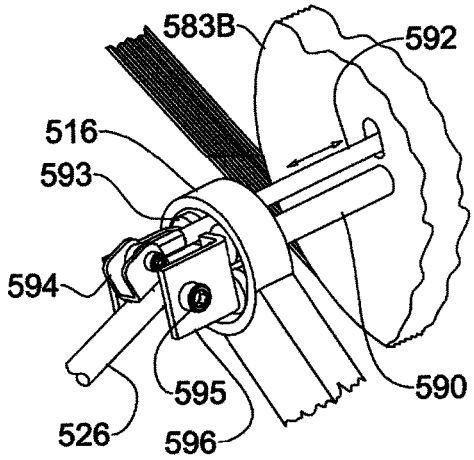
FIG. 21 is a partial enlarged detail of the device shown in FIG. 20

A second momentum enhancement system embodiment, indicated as device 510B, shown in FIGS. 20 and 21, is an alternative system to device 510A that is coupled to a "swing" bar system, shown in FIG. 19. Device 510B shows an alternative method having an equivalent momentum enhancement influence to the knee pivot travel as compared to the swing bar method (527) having a center pivot mount 573 to a frame member 514, where the ends of the swing bar transmit an equal opposite directional distance of travel (T) to the linkages that couple to each end of the "swing bar." In this embodiment 510B, distance of rotational travel (T) is a function of the variable radial circumference path produced by each end of the rotating extension rods 526 which are pivotally coupled to the linkage rods 528B which are shown to travel in a generally vertical position and generally reciprocate up and down as directed by the rotating extension rods 526, and where the opposite upper ends of rods 528B pivotally attached to elements of the device (not shown) that communicate with the knee pivot joints of the device.

The left and right hand rotating extension rods 526 and 526' communicate to one another to generally move in an opposite swing phase to ultimately influence or to be influenced by the knee pivot joints to generally move respectively in an equal opposite swing phase fashion along with the extension rods 526. It should be appreciated that the communication between extension rods 526 and 526' may be dependently linked in a close tolerance fashion using a rigid linkage 592, best seen in FIG. 21, which each end of linkage 592 pivotally connects to offset bracket 594 that is affixed near to the end of rotation rod 526 that is the opposite end that pivotally couples to linkages 528B. This same end of rotation rod 526 pivotally couples to the main rotating high torque axil system 590 via pivotal attachment at through bolt 595 though bracket 596 which is affixed to axil rod 590, such that the rotating extension rod's axis may align with axis of the torque axil rod 590. The torque axil rod 590 passes through both housing rings 516 and through the high torque sheave 583B to which it attaches. High torque sheave 583B is coupled to the smaller sheave 581B which is fixed to flywheel 580B, both sharing the same axil. Axil rod 590 rotates within the center of each housing ring 516 by way of guide rollers 593 that rotate and travel within same housing rings 516; which guide rollers 593 are pivotally mounted to the backside of each bracket 596. Each housing ring 516 may be held in a fixed position relative to the frame through the use of tubes 514 having their opposite ends than affixed to frame base member 512B. It should be appreciated the mounting position of this device 510B may be elsewhere as best suited to the particular device it may be used. As mentioned earlier, the communication system illustrated as device 510B is shown to use a rigidly dependent communication means via linkage 592 to provide close tolerance opposite swing phase of the knee pivot joints or another type of exercise machine having foot pedals, yet a modified linkage 592 may not be rigid to allow the left and right hand rotation rods to move out of strict opposite phase. Not shown, the linkage 592 whether rigid or not may be moveable through the user manually changing their knee stride range during exercise, or the linkage member 592 may be operated through another type of manual, automatic, or programmable system.

Figure 22:
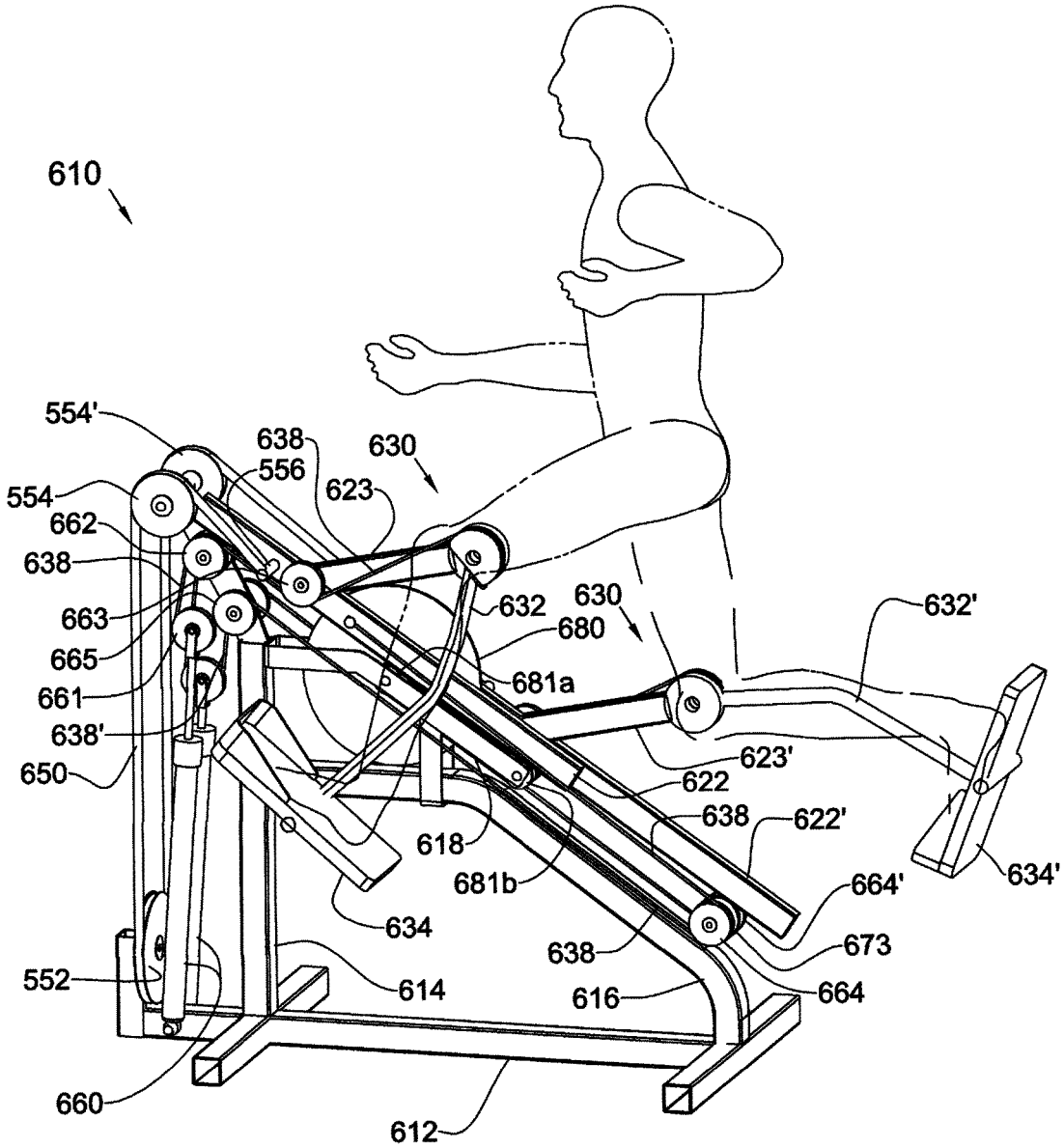
FIG. 22 is an isometric view of a device providing friction rollers coupled to a flywheel to drive and be driven by sliding members that support the knee pivot joint.

Another momentum enhancement system, shown within device 610, in FIG. 22; features a continuous rotating flywheel 680, which is coupled to a set of high fiction rollers 681*a* and 681*a*' (not shown), via having all these components sharing and affixed to a rigid rod member center axil, that provides that the flywheel 680 and friction rollers 681*a* and 681*a*' (not shown) may rotate together as a single unit, and rotate freely as contained within and between the two sides of the frame bracket side plates 618. Looking at the left side of device, the roller 681*a* is shown coupled to a same left side of device roller 681*b*, by way of a chain or belt, such that both rollers rotate at the same rate and in unison. It should be appreciated, that one roller may work adequately enough to provide the friction necessary to which the leg slide member 622 undersurface may both drive the flywheel 680, as the slide member 622 is driven downward and rearward by the user; where simultaneously, the roller 681*a* and (as shown) roller 681*b* may also provide that the user's rearward gate travel is regulated (made more fluid, continuous, and rate controlled) through the stabilizing influence of the flywheel 680. The influence of the flywheel 680 acting upon the rearward movement of the slide members 622 and 622' not only provides the user a greater sense of stability, but further provides a more realistic sense that the user is traveling forward on land; where the user's mass in motion on land, provides a momentum force toward continuous motion to which this device 610 as well as the other momentum enhancement devices shown in FIGS. 19-21 try to simulate.

At the completion of the rearward gate path, marked by the user transferring body weight from the one foot pedal 634' to the opposite foot pedal 634; this reduction of downward force between the underside of the slide member 622' against the rollers 681*a* & 681*b*, no longer provides a positive connection, whereby the force of both the user taking a stride forward and/or the forward pull from the elastic member 650, provides that the knee pivots 630 and associated slide members will return forward in a fashion that closely follows the natural gait of the user's forward returning leg, preferably at a rate that does not hinder that user forward leg return. The elastic member 650 is shown as a continuous loop as directed by the base idler pulley 552 and associated upper frame idler pulleys 554 and 554', where each end of the elastic member 650 terminates and attaches to each respective slide member 622 and 622'. It should be appreciated that there may be two individual and independent elastic members, one per each side of the device 610 to act on each individual left and right hand slide member.

In addition to the momentum rate control system action upon the movement of the knee pivot joints 630, as described above for this device 610; it is further necessary to provide a lift and dampening system to the action of the foot pedals 634 through their connection to their knee pivot joint through the "calf" linkage, as is typical throughout this invention. Device 610 provides resistance to the lowering of the foot pedals 634, or in other words, the straightening of the user's knees; as well as, a lifting force to help bend the knee and to provide that the foot pedal remains under foot as the user lifts their feet, which is accomplished using the typical fitness cylinder 660 which each has a return springs. This device 610 shows a unique system, which allows the fitness cylinders 650 to be mounted to the frame, so that the cylinders will not add an additional unwelcomed mass to the slide members, which would hinder the desired quick rate response to which the slide members need to change direction, so that the user may enjoy a more nimble experience. Before this system is further described, it should be appreciated that a dampening and lift system may be made a part of the slide system; or this device may incorporate the dampening and lift bar system, generally labeled 70, and first shown in FIG. 3. The unique cable and idler pulley system shown here and incorporated into device 610, provides that the sliding movement of the slide members 622 and 622' will not cause the fitness cylinders 660 to engage or reset; yet through this configuration, only the rotation of the calf linkage 632 about the knee pivot 630 will engage the dampening and spring return to and from the fitness cylinders 650.

As device 610 shows an all mechanical method of providing momentum force simulation to the device, as well as, lift and dampening forces on the knee rotation; it should be appreciated that electronic devices may substitute in a variety of ways to simulate the basic requirements to ensure the user obtains the basic user-defined, freeform, natural gait pattern that may accurately simulate real world experience.

As this present invention does not illustrate use of a forward mounted to frame monitoring or entertainment console, it should be appreciated that a console could be made available through attachment to the devise, or to an independent console wired to or wirelessly communicating with the device, or the device may communicate using an electronic interactive component, such as a smart television, computer, or other Wi-Fi apparatus.

The invention claimed is:

1. An exercise device comprising:

a base frame;

first and second calf linkages, the first and second calf linkages each including an upper end and a lower end;

first and second foot pedals; the first foot pedal being disposed at the lower end of the first calf linkage, and the second foot pedal being disposed at the lower end of the second calf linkage;

first and second pivot joints, the first pivot joint being disposed at the upper end of the first calf linkage, and the second pivot joint being disposed at the upper end of the second calf linkage; and first and second knee pivot support assemblies, the first knee pivot support assembly including one or plural support members and a third pivot joint, the one or plural support members of the first knee pivot support assembly being coupled at a first end with the third pivot joint and being coupled at a second end with the first pivot joint to define a path along which the first pivot joint may move, and the second knee pivot support assembly including one or plural support members and a fourth pivot joint, the one or plural support members of the second knee pivot support assembly being coupled at a first end with the fourth pivot joint and being coupled at a second end with the second pivot joint to define a path along which the second pivot joint may move, wherein the third and fourth pivot joints are configured to be substantially located at or below a height of the first and second pivot joints, wherein the first and second pivot joints are configured to be located adjacent to a knee of a user standing on the first and second foot pedals, and wherein the third and fourth pivot joints respectively coupled with the one or plural support members of the first and second knee pivot support assemblies are configured to be located below a hip of the user standing on the first and second foot pedals.

2. The exercise device according to claim 1, wherein the third and fourth pivot joints are configured to be located at about the height of the first and second pivot joints.

3. The exercise device according to claim 1, wherein the third and fourth pivot joints are disposed on the base frame.

4. The exercise device according to claim 1, wherein the third and fourth pivot joints are spaced from the base frame.

5. The exercise device according to claim 1, wherein the first and second knee pivot support assemblies each include a plurality of support members and at least one pivot joint coupling a first of the plurality of support members with a second of the plurality of support members.

6. The exercise device according to claim 5, wherein each plurality of support members includes a pair of support members with opposed ends coupled by a transverse support member via pivot joints at opposite ends of the transverse support member.

7. The exercise device according to claim 5, wherein the at least one pivot joint of the first knee pivot support assembly is the third pivot joint, and wherein the at least one pivot joint of the second knee pivot support assembly is the fourth pivot joint.

8. The exercise device according to claim 6, wherein the pair of support members are parallel to one another.

9. The exercise device according to claim 6, wherein a length of each of the pair of support members is adjustable to change a radius of the path along which the first and second pivot joints may move.

10. The exercise device according to claim 1, wherein a top of the base frame is configured to be located below the hip of the user standing on the first and second foot pedals.

11. The exercise device according to claim 1, further comprising a first lift and dampening mechanism coupled to the first knee pivot support assembly, and a second lift and dampening mechanism coupled to the second knee pivot support assembly.

12. The exercise device according to claim 11, wherein the first lift and dampening mechanism includes a first cylinder coupled between the base frame and the first knee pivot support assembly, and the second lift and dampening mechanism includes a second cylinder coupled between the base frame and the second knee pivot support assembly.

13. The exercise device according to claim 11, wherein the first lift and dampening mechanism includes a first rail pivotably coupled with the base frame, and wherein the second lift and dampening mechanism includes a second rail pivotably coupled with the base frame.

14. The exercise device according to claim 1, further comprising a first lateral pivot assembly and a second lateral pivot assembly, wherein the first knee pivot support assembly is coupled with the first lateral pivot assembly to permit laterally inward and outward movement of the first foot pedal, and wherein the second knee pivot support assembly is coupled with the second lateral pivot assembly to permit laterally inward and outward movement of the second foot pedal.

15. The exercise device according to claim 14, wherein the first lateral pivot assembly includes a first lateral pivot joint and a first linkage system coupling the first knee pivot support assembly with the first lateral pivot joint, and wherein the second lateral pivot assembly includes a second lateral pivot joint and a second linkage system coupling the second knee pivot support assembly with the second lateral pivot joint.

16. The exercise device according to claim 15, wherein the first linkage system includes a first four bar linkage system, and wherein the second linkage system includes a second four bar linkage system.

17. The exercise device according to claim 1, further comprising a flywheel coupled with the first and second knee pivot support assemblies.

18. The exercise device according to claim 17, further comprising first and second rods, wherein the flywheel is coupled with the first knee pivot support assembly via the first rod, and wherein the flywheel is coupled with the second knee pivot support assembly via the second rod.

19. The exercise device according to claim 18, further comprising a rotary coupling mechanism coupled with the flywheel and the first and second rods, wherein the rotary coupling mechanism is configured to convert rotary movement of the flywheel to reciprocating movement of the first and second rods.

20. The exercise device according to claim 19, wherein the rotary coupling mechanism includes first and second extension rods extending in opposite directions from a rotary shaft.

21. The exercise device according to claim 19, wherein the rotary coupling mechanism includes a swing bar.

22. The exercise device according to claim 17, further comprising first and second rollers, wherein the first knee pivot support assembly is coupled with the flywheel via the first roller, and wherein the second knee pivot support assembly is coupled with the flywheel via the second roller.

* * * * *